US009535389B2

(12) United States Patent
Muramatsu et al.

(10) Patent No.: US 9,535,389 B2
(45) Date of Patent: Jan. 3, 2017

(54) ROLLER MEMBER, SHEET FEEDING APPARATUS AND IMAGE FORMING APPARATUS

(71) Applicant: CANON KABUSHIKI KAISHA, Tokyo (JP)

(72) Inventors: Motoyasu Muramatsu, Susono (JP); Satoshi Tsuda, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/803,193

(22) Filed: Jul. 20, 2015

(65) Prior Publication Data

US 2016/0026141 A1 Jan. 28, 2016

(30) Foreign Application Priority Data

Jul. 25, 2014 (JP) ..... 2014-151768
Jul. 6, 2015 (JP) ..... 2015-135293

(51) Int. Cl.

| | |
|---|---|
| ***B65H 3/06*** | (2006.01) |
| ***G03G 15/00*** | (2006.01) |
| ***B65H 5/02*** | (2006.01) |
| ***B65H 5/06*** | (2006.01) |
| ***B41F 21/00*** | (2006.01) |

(52) U.S. Cl.

CPC ..... *G03G 15/6529* (2013.01); *B41F 21/00* (2013.01); *B65H 5/021* (2013.01); *B65H 5/06* (2013.01)

(58) Field of Classification Search

CPC ..... B65H 3/06; B65H 3/0638; B65H 3/0615; B65H 2404/111; B65H 2404/1112; B65H 2404/1113;B65H 2404/1118; B65H 2404/112; B65H 2404/1122; B65H 2404/12; B65H 2404/1375; B65H 2404/2571; B65H 1/04; F16C 13/00

USPC ..... 271/109; 492/18, 16

See application file for complete search history.

(56) References Cited

U.S. PATENT DOCUMENTS

| | | | | |
|---|---|---|---|---|
| 8,511,672 | B2 * | 8/2013 | Kubo | B65H 3/0638 271/119 |
| 8,746,679 | B2 * | 6/2014 | Hanyu | B65H 3/0638 193/37 |
| 9,302,866 | B1 * | 4/2016 | Manor | B65H 3/0638 |

(Continued)

FOREIGN PATENT DOCUMENTS

| | | | |
|---|---|---|---|
| JP | 8-157086 | * | 6/1996 |
| JP | 2002-104675 A | | 4/2002 |

*Primary Examiner* — Thomas Morrison

(74) *Attorney, Agent, or Firm* — Fitzpatrick, Cella, Harper & Scinto

(57) ABSTRACT

A roller member includes an endless belt elastically deformable and configured to convey a sheet and a holding unit holding the endless belt. The holding unit includes a first holding portion being in contact with an inner circumferential surface of the endless belt, a second holding portion being in contact with an outer circumferential surface of the endless belt and movable with respect to the first holding portion, and an engage portion engaging with an engaged portion. The second holding portion is moved with respect to the first holding portion by resilient force of the endless belt in a state in which the second holding portion is in contact with the outer circumferential surface of the endless belt in response to a disengagement of the engage portion from the engaged portion.

15 Claims, 25 Drawing Sheets

(56) References Cited

U.S. PATENT DOCUMENTS

2013/0049288 A1* 2/2013 Kubo ..... B65H 3/0638
271/119

* cited by examiner

ROLLER MEMBER, SHEET FEEDING APPARATUS AND IMAGE FORMING APPARATUS

BACKGROUND OF THE INVENTION

Field of the Invention

The present invention relates to a roller member being capable of conveying a sheet, a sheet feeding apparatus, and an image forming apparatus.

Description of the Related Art

In an image forming apparatus such as a copier and a printer including a sheet feeding apparatus feeding a sheet, a feed roller feeding the sheet is replaced as consumables by an operator such as a user and a service person, so that the feed roller is required to have high feeding performance and to be readily replaceable in the same time. Due to that, conventionally, there have been proposed sheet feeding apparatuses including various replacement mechanisms in order to improve replaceability of the feed roller.

Japanese Patent Application Laid-open No. 2002-104675 discloses a sheet feeding apparatus including such a replacement mechanism. That is, in the sheet feeding apparatus, a feed roller includes a roller base supported by a driving shaft, a substantially circular arc belt supporting member supported by the roller base, and an endless elastic belt member wrapped around the belt supporting member. According to this configuration, a part of the elastic belt member, exposed out of the belt supporting member, is configured to be a circular arc conveying portion rubbing and feeding a sheet, and a region other than the conveying portion of the elastic belt member is held on the roller base side.

This sheet feeding apparatus is configured such that the belt supporting member in a state of supporting the elastic belt member is assembled to the roller base while elastically deforming the region other than the conveying portion of the elastic belt member by pressing against the driving shaft. At this time, while the elastic belt member generates resilient force by being elastically deformed, the belt supporting member is fixed to the roller base by a lock portion (snap fit) by resisting against this resilient force. Therefore, if the lock portion is unlocked in removing the belt supporting member from the roller base due to maintenance or the like, the belt supporting member is detached from the roller base by the resilient force generated by the restoring elastic belt member.

Lately, downsizing of the feed roller and of the sheet feeding apparatus is required along with a demand on downsizing of the image forming apparatus. However, if the feed roller is downsized in the configuration described above, the conveying portion may be shortened. Therefore, it may become difficult to convey a sheet, by a single rotation of the feed roller, to a point where a tip of the sheet comes into contact with a drawing roller downstream in a sheet feeding direction.

Then, if the belt supporting member is configured so as to prolong a circular arc length thereof while keeping an outer circumferential length of the elastic belt member for the purpose of prolonging the conveying portion of the feed roller, an elastic deformation volume of the elastic belt member in attaching the elastic belt member to the belt supporting member may increase. Then, the resilient force in removing the belt supporting member from the roller base increases, and there is a possibility that the belt supporting member jumps out vigorously and falls down.

Still further, if the outer circumferential length of the belt is prolonged for the purpose of restraining the resilient force of the elastic belt member, there is a possibility that the elastic belt member is loosened and/or drops out of the belt supporting member after removing the belt supporting member out of the roller base, and consequently the replaceability of the elastic belt member may be hampered.

SUMMARY OF THE INVENTION

According to one aspect of the invention, a roller member includes an endless belt elastically deformable and configured to convey a sheet and a holding unit holding the endless belt. The holding unit has a first holding portion being in contact with an inner circumferential surface of the endless belt, a second holding portion being in contact with an outer circumferential surface of the endless belt and movable with respect to the first holding portion, and an engage portion engaging with the engaged portion. The second holding portion is moved with respect to the first holding portion by resilient force of the endless belt in a state in which the second holding portion is in contact with the outer circumferential surface of the endless belt in response to a disengagement of the engage portion from the engaged portion.

According to another aspect of the invention, a roller member includes an endless belt elastically deformable and configured to convey a sheet, a shaft having an engaged portion and rotating integrally with the endless belt, and a holding unit holding the endless belt. The holding unit has a first holding portion being in contact with an inner circumferential surface of the endless belt, a second holding portion being in contact with an outer circumferential surface of the endless belt and movable with respect to the first holding portion, and an engage portion engaging with the engaged portion. The second holding portion is attached to the first holding portion after when the inner circumferential surface of the endless belt is brought into contact with the first holding portion.

According to a still other aspect of the invention, a roller member includes an endless belt elastically deformable and configured to convey a sheet and a holding unit holding the endless belt. The holding unit has a first holding portion being in contact with an inner surface of the endless belt and a second holding portion having a contact portion being in contact with an outer surface of the endless belt. The holding unit has parts disposed on both outer sides of the endless belt in a direction of a rotation axial line of the endless belt respectively and partially overlapping with the endless belt viewing from the direction of the rotation axial line of the endless belt.

Further features of the present invention will become apparent from the following description of exemplary embodiments with reference to the attached drawings.

DESCRIPTION OF THE EMBODIMENTS

<First Embodiment>

Figure 1:
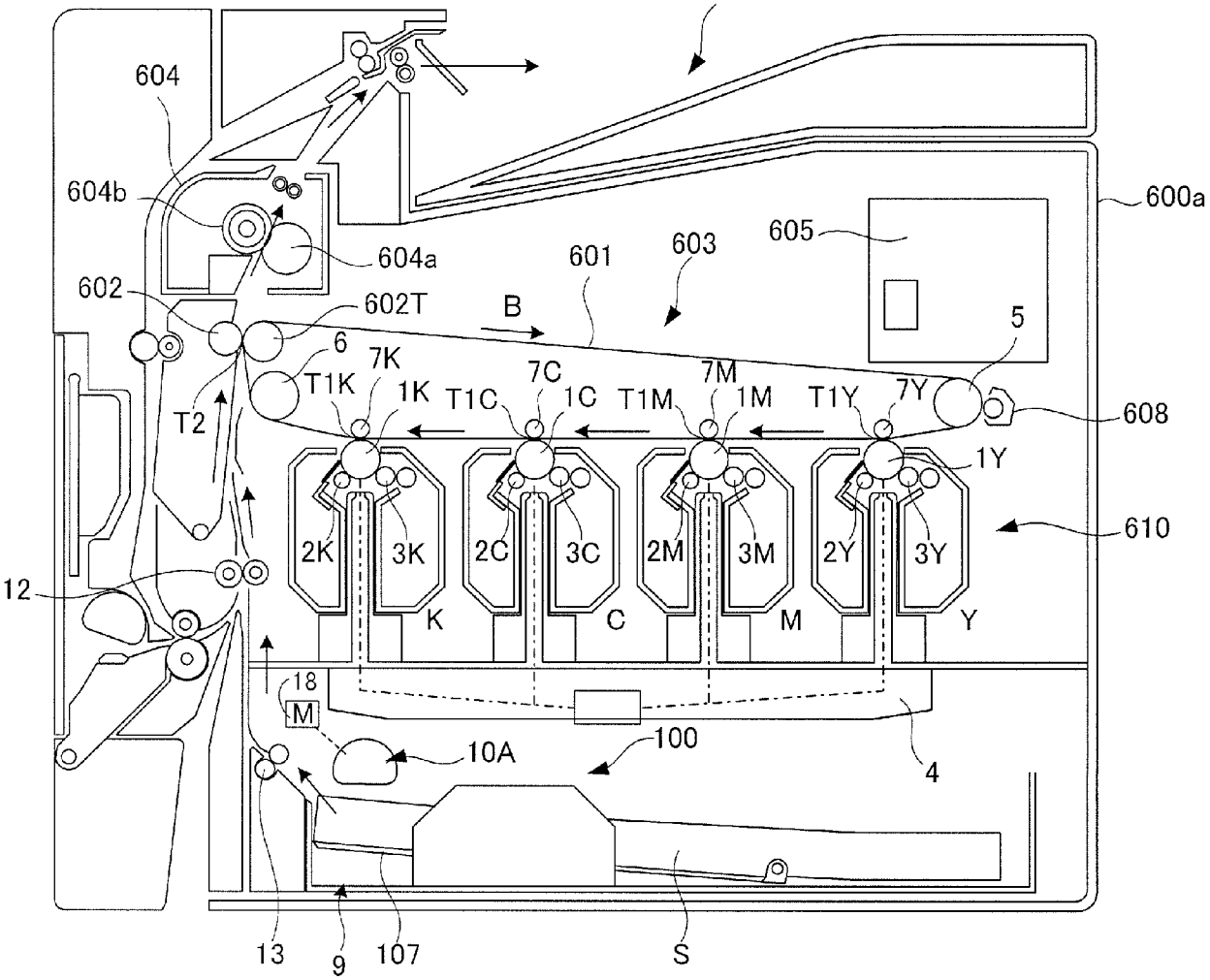
FIG. 1 is a section view schematically illustrating a configuration of an image forming apparatus of a first embodiment.

An electro-photographic image forming apparatus such as a copier and a printer and a sheet feeding apparatus included in the image forming apparatus will be exemplified and described below with reference to the drawings. FIG. 1 is a section view schematically illustrating a configuration of the image forming apparatus 600 including the sheet feeding apparatus 100 of the present embodiment.

[Image Forming Apparatus]

As shown in FIG. 1, the image forming apparatus 600 is a tandem-type electro-photographic color laser printer using an intermediate transfer belt 601. The image forming apparatus 600 includes an image forming apparatus body (referred to as an 'apparatus body' hereinafter) 600*a*. An intermediate transfer belt unit 603 is disposed at an upper part of the apparatus body 600*a*, and the sheet feeding apparatus 100 is disposed at a lower part thereof.

The image forming apparatus 600 includes four image forming portions Y, M, C, and K forming toner images of respective colors of yellow, magenta, cyan, and black. These image forming portions Y, M, C, and K are arrayed within the apparatus body 600*a* in order from the right side to the left side in FIG. 1.

The image forming portions Y, M, C, and K are electro-photographic image forming type image forming portions and are configured in the same manner except that each one forms a toner image of different color on a photosensitive drum of each image forming portion. Each image forming portion includes the photosensitive drum 1 (1Y, 1M, 1C or 1K). Disposed around the photosensitive drum 1 are, as a processing mechanism, a charging roller 2 (2Y, 2M, 2C or 2K), a developing roller 3 (3Y, 3M, 3C or 3K), a transfer roller 7 (7Y, 7M, 7C or 7K) and a cleaning blade. Still further, a laser scanner 4 irradiating laser beams corresponding to image information to each one of the photosensitive drums 1 is disposed below the respective photosensitive drums 1.

Next, an image forming operation of each image forming portion Y, M, C or K will be described. In the image forming operation, each photosensitive drum 1 is rotationally driven counterclockwise in FIG. 1. In this state, the photosensitive drum 1 is electrified by the charging roller 2. The laser scanner 4 irradiates the laser beam to the photosensitive drum 1 to form a latent image (electrostatic latent image) thereon. Toner carried by the developing roller 3 is applied to the latent image to form a toner image on the surface of the photosensitive drum 1.

A yellow toner image, i.e., a color separation component color of a full color image is formed on a surface of the photosensitive drum 1Y of the image forming portion Y, and a magenta toner image is formed on a surface of the photosensitive drum 1M of the image forming portion M. Still further, a cyan toner image is formed on a surface of the photosensitive drum 1C of the image forming portion C and a black toner image is formed on a surface of the photosensitive drum 1K of the image forming portion K.

Meanwhile, an intermediate transfer belt unit 603 including an intermediate transfer belt 601 onto which the toner images are transferred is disposed above the respective image forming portions Y, M, C, and K. The intermediate transfer belt 601 is stretched around three rollers arrayed in parallel, i.e., a tension roller 5 disposed on a right side, a tension roller 6 disposed on a left side, respectively in FIG. 1, and a secondary transfer counter roller 602T disposed above the tension roller 6. The tension roller 6 is rotationally driven by a driving source not shown to drive the intermediate transfer belt 601 in a direction of an arrow B (clockwise) such that surface speed of the intermediate transfer belt 601 is substantially equalized with surface speed of the respective photosensitive drums.

The primary transfer rollers 7Y, 7M, 7C, and 7K are disposed between the tension rollers 5 and 6 so as to face the respective photosensitive drums of the image forming portions Y, M, C, and K while interposing the intermediate transfer belt 601 between them and form primary transfer nip portions T1Y, T1M, T1C, and T1K. Primary transfer bias is applied to each primary transfer nip portion T1 to primarily transfer the toner image on each photosensitive drum onto the intermediate transfer belt.

A secondary transfer roller 602 is disposed downstream, in the rotation direction of the intermediate transfer belt 601, of the primary transfer nip portion T1 so as to face the secondary transfer counter roller 602T while interposing the intermediate transfer belt 601. The secondary transfer roller 602 presses the secondary transfer counter roller 602T through the intermediate transfer belt 601. The intermediate transfer belt 601 and the secondary transfer roller 602 form a secondary transfer nip portion T2. The toner image on the intermediate transfer belt 601 is secondarily transferred onto a sheet at the secondary transfer nip portion T2 to which a secondary transfer bias is applied.

An intermediate transfer belt cleaner 608 scraping toner left without being transferred at the secondary transfer nip portion T2 is disposed at a position facing the tension roller 5 downstream, in the rotation direction of the intermediate transfer belt 601, of the secondary transfer nip portion T2.

A fixing unit 604 is disposed downstream in the sheet conveying direction of the secondary transfer nip portion T2. The fixing unit 604 is composed of a fixing roller (heating roller) 604*a* and a pressure roller 604*b* facing in pressure contact with the fixing roller 604*a*.

It is noted that in the present embodiment, the image forming portions Y, M, C, and K, the secondary transfer nip portion T2, and the fixing unit 604 constitute an image forming unit 610 forming an image on a sheet S fed from the sheet feeding apparatus 100.

Next, a process for forming the four color toner images on the sheet S will be described. A control portion 605, i.e., a control unit, controlling the image forming operation of the image forming apparatus 600 is disposed within the apparatus body 600*a*. Based on a print starting signal, the control portion 605 forms toner images of yellow, magenta, cyan, and black on the respective photosensitive drums of the image forming portions Y, M, C, and K. The respective toner images are sequentially superimposed and transferred onto the intermediate transfer belt 601 at the primary transfer nip portions T1 to be formed into a four color toner image on the intermediate transfer belt 601. The four color toner image is then moved to the secondary transfer nip portion T2.

The control portion 605 also controls drive of a feed roller 10A, i.e., a roller member, and of a conveying roller pair 13 located along a sheet conveying path, both provided in the sheet feeding apparatus 100. Then, the control portion 605 rotationally drives the feed roller 10A to separate and feed the sheet S stacked and stored within a sheet feed cassette 9 one by one. The control portion 605 also rotationally drives the conveying roller pair 13 to convey the sheet S to a registration roller pair 12. The registration roller pair 12 introduces the sheet S to the secondary transfer nip portion T2 while matching a sheet reaching timing with a timing when the toner image on the intermediate transfer belt 601 arrives at the secondary transfer nip portion T2. Then, the control portion 605 secondarily transfers the four color toner image on the intermediate transfer belt 601 onto the sheet S by applying the secondary transfer bias. The control portion 605 conveys the sheet S which has passed through the secondary transfer nip portion T2 to the fixing unit 604 to fix the non-fixed toner image onto the sheet S by applying heat and pressure. The four color toner image is thus formed on the sheet S.

[Sheet Feeding Apparatus]

Next, the sheet feeding apparatus 100 will be described in detail with reference to FIGS. 2 and 3. It is noted that FIG. 2 is a perspective view detailing the sheet feeding apparatus 100 and FIG. 3 is a section view illustrating the sheet feeding apparatus 100.

Figure 2:
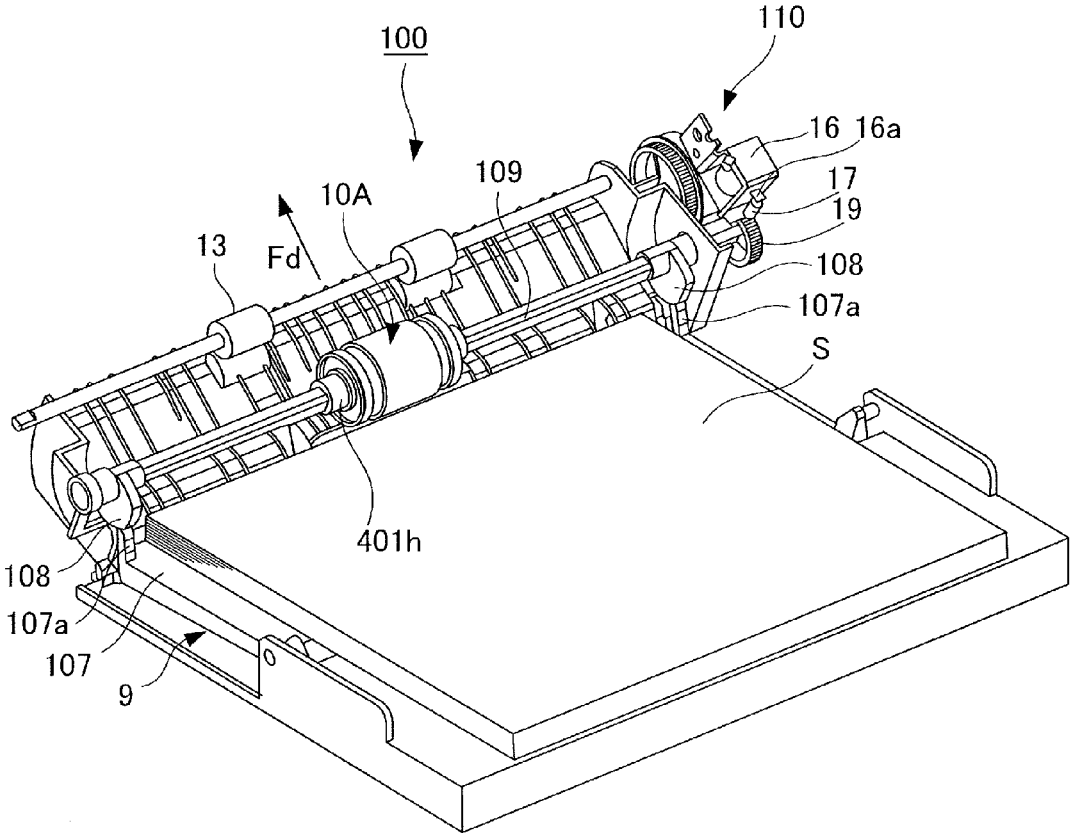
FIG. 2 is a perspective view illustrating a sheet feeding apparatus of the first embodiment.
Figure 3:
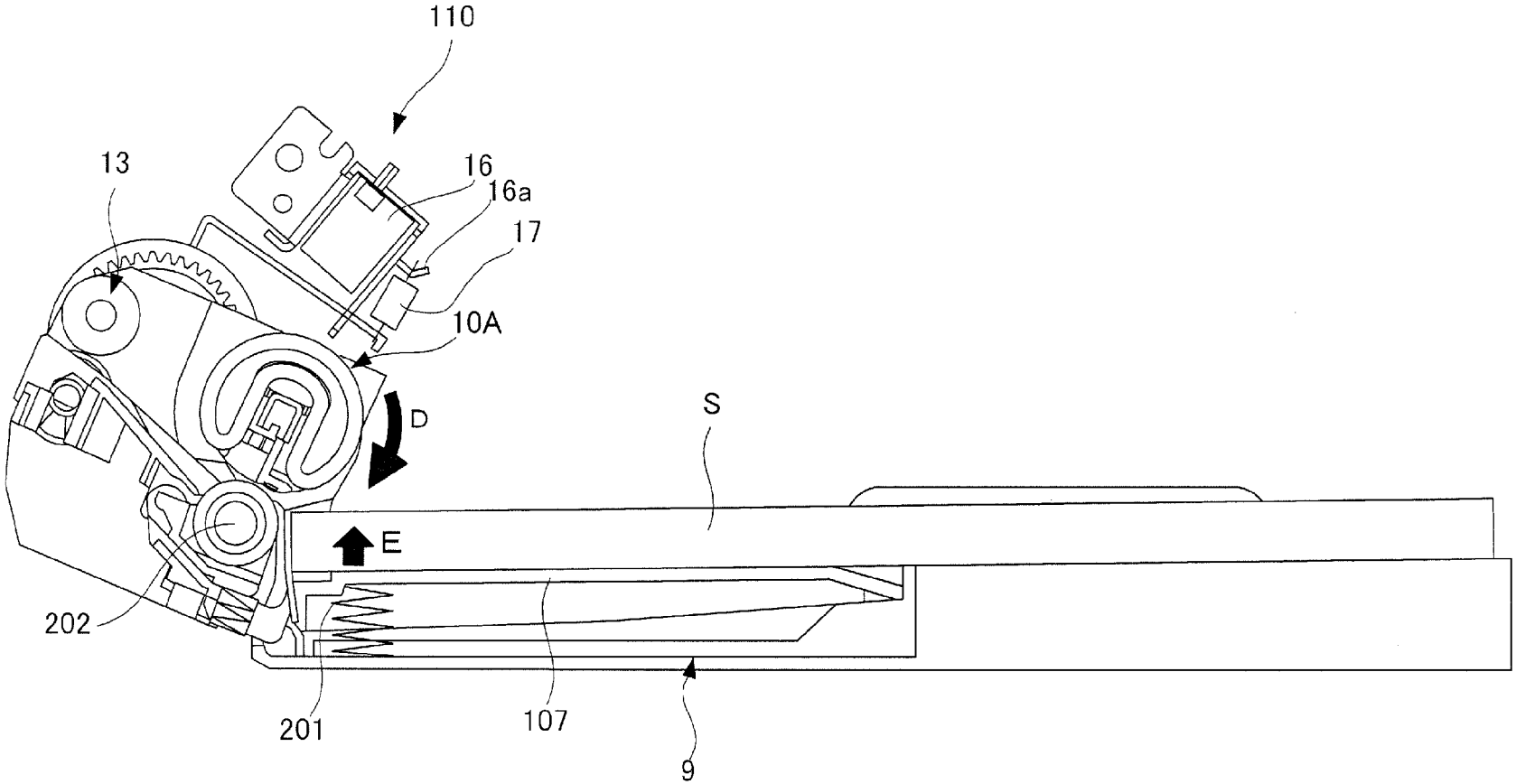
FIG. 3 is a section view illustrating the sheet feeding apparatus of the first embodiment.

As shown in FIGS. 2 and 3, the feed roller 10A is disposed near a front end of an uppermost sheet S among sheets S stacked on a stacking tray 107, i.e., a sheet stacking portion, provided in the sheet feed cassette 9. Based on the print starting signal, the control portion 605 (see FIG. 1) transmits a drive signal to a driving motor 18 (see FIG. 1), i.e., a driving unit, rotationally driving the feed roller 10A.

A drive transmitting mechanism 110 is disposed between the driving motor 18 and the feed roller 10A. The control portion 605 drives the driving motor 18 (see FIG. 1) based on the print starting signal. The drive transmitting mechanism 110 transmits driving force of the driving motor 18 to the feed roller 10A and releases the transmission every time when the feed roller 10A rotates once. One sheet is fed by one rotation of the feed roller 10A. The drive transmitting mechanism 110 is arranged to repeat the rotation and the stoppage every time when the feed roller 10A rotates once by a single revolution clutch using a solenoid 16, a tooth-lacking gear 19 and others. It is noted that instead of this arrangement, it is also possible to use a clutch mechanism using an electromagnetic clutch or the like. The drive transmitting mechanism 110 also includes a compression spring 17 provided to urge a lever 16*a* connected to the solenoid 16.

The apparatus body 600*a* supports a driving shaft 109 to which roller base 401 (see FIG. 7A) is fixed. The driving shaft 109 extends in a width direction orthogonal to a sheet feeding direction (direction of an arrow first embodiment) in which the sheet S stacked on the stacking tray 107 in the sheet feed cassette 9 is delivered. The driving shaft 109 rotationally drives the feed roller 10A while removably holding the feed roller 10A. The feed roller 10A is attached at an axial center part of the driving shaft 109, and lift cams 108 are fixed at axial both ends of the driving shaft 109, respectively, so that they assume predetermined phases.

The driving shaft 109 is configured to be rotatable integrally with the feed roller 10A and the lift cam 108 in transmitting the rotation of the driving motor 18 to the driving shaft 109 through the drive transmitting mechanism 110. Still further, cam followers 107*a* respectively facing the corresponding lift cams 108 are provided at the widthwise both ends orthogonal to the sheet feeding direction of the stacking tray 107.

As shown in FIG. 3, the stacking tray 107 is pushed up in a direction of an arrow E in FIG. 3 by a press spring 201, i.e., a press member. When the rotation of the driving motor 18 is transmitted to the feed roller 10A, the lift cam 108 shown in FIG. 2 rotates in a direction of an arrow D together with the feed roller 10A and causes the cam follower 107*a* shown to follow the lift cam 108. Due to that, the sheet S on the stacking tray 107 is pushed up to the feed roller 10A by the press spring 201 and is delivered out of the sheet feed cassette 9 by the rotating feed roller 10A.

Then, the sheet S is fed and separated one by one by a separating action of the separation roller 202 and the feed roller 10A and is sent to the conveying roller pair 13 located downstream of the feed roller 10A. The separation roller 202 is fixed to a frame of the sheet feed cassette 9 through a torque limiter. Then, when a single sheet S is introduced into a separation nip portion between the separation roller 202 and the feed roller 10A, the separation roller 202 rotates following the rotation of the feed roller 10A by being dragged by the sheet S. However, when multiple sheets S are introduced into the separation nip portion, the separation roller 202 stops rotating without conveying the second sheet and thereafter.

Figure 4A:
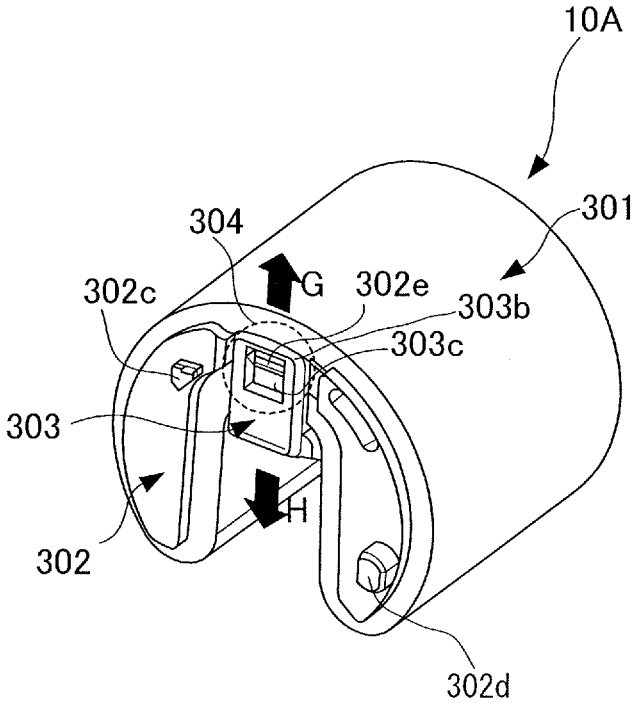
FIG. 4A is a perspective view illustrating a feed roller of the first embodiment.
Figure 4B:
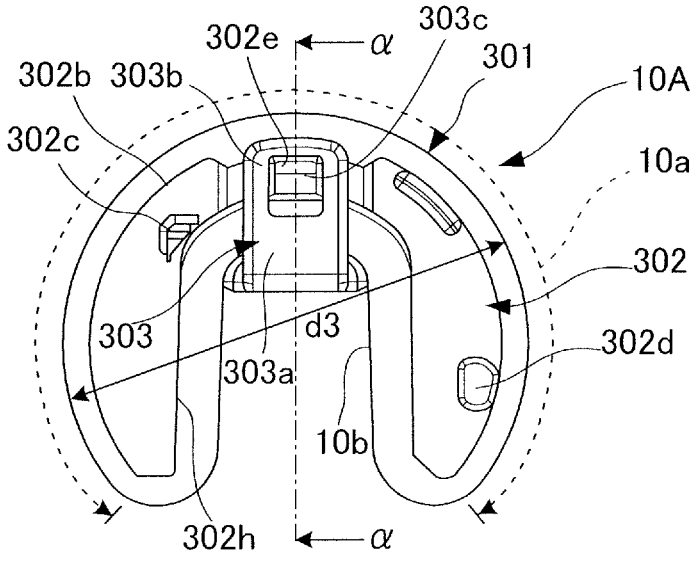
FIG. 4B is a front view of the feed roller of the first embodiment.
Figure 5A:
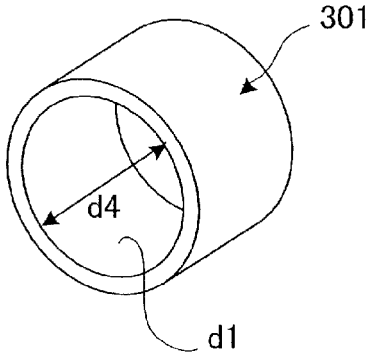
FIG. 5A is a perspective view illustrating a rubber belt of the feed roller of the first embodiment.

Next, a configuration of the feed roller 10A, i.e., one exemplary roller member, will be described in detail with reference to FIGS. 4A through 6. It is noted that FIG. 4A is a perspective view illustrating the feed roller 10A of the present embodiment and FIG. 4B is a front view of the feed roller 10A shown in FIG. 4A viewed from the left side thereof. FIGS. 5A through 5E illustrate components and an assembling process of the feed roller 10A of the present embodiment. FIG. 6 is a section view of the feed roller of the present embodiment taken along a line α-α in FIG. 4B.

As shown in FIGS. 4A and 4B, the feed roller 10A includes a circular arc frictional conveying portion 10*a* (region indicated by a broken line in FIG. 4B) being in contact with the sheet S stacked on the stacking tray 107 (see FIG. 1) and delivering the sheet S in the sheet feeding direction. The feed roller 10A also includes a rubber belt 301, i.e., an endless belt (elastic belt member), a roller core 302, i.e., a first holding portion, and a belt holder 303, i.e., a second holding portion. The endless belt is formed into an endless shape (tubular shape) by an elastically deformable material such as rubber. The roller core 302 (the first holding portion) is in contact with an inner circumferential surface (inner circumference) of the rubber belt 301, and the belt holder 303 (the second holding portion) is contact with an outer circumferential surface (outer circumference) of the rubber belt 301. That is, the roller core 302 and the belt holder 303 constitute a holding unit holding the rubber belt 301, and the rubber belt 301 rotates centering on an axis of the driving shaft 109 as a rotational axial line in a state being held by the holding unit.

Figure 5C:
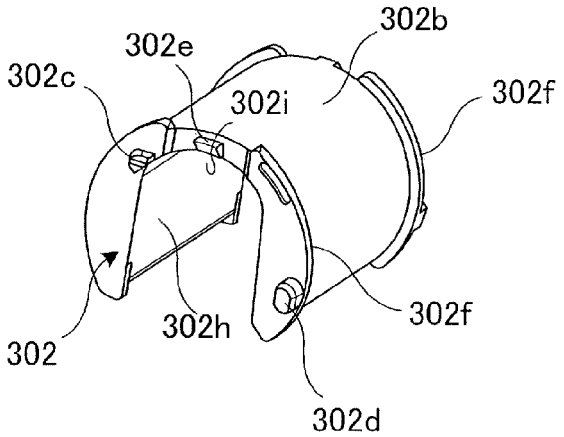
FIG. 5C is a perspective view illustrating the roller core shown in FIG. 5B.
Figure 5B:
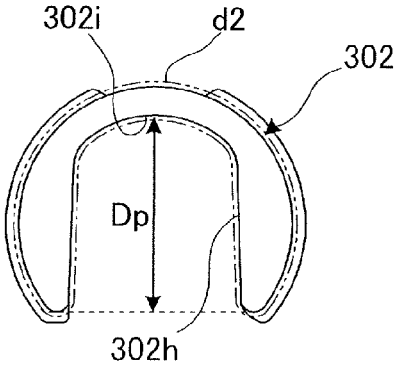
FIG. 5B is a front view illustrating a roller core of the feed roller of the first embodiment.
Figure 6:
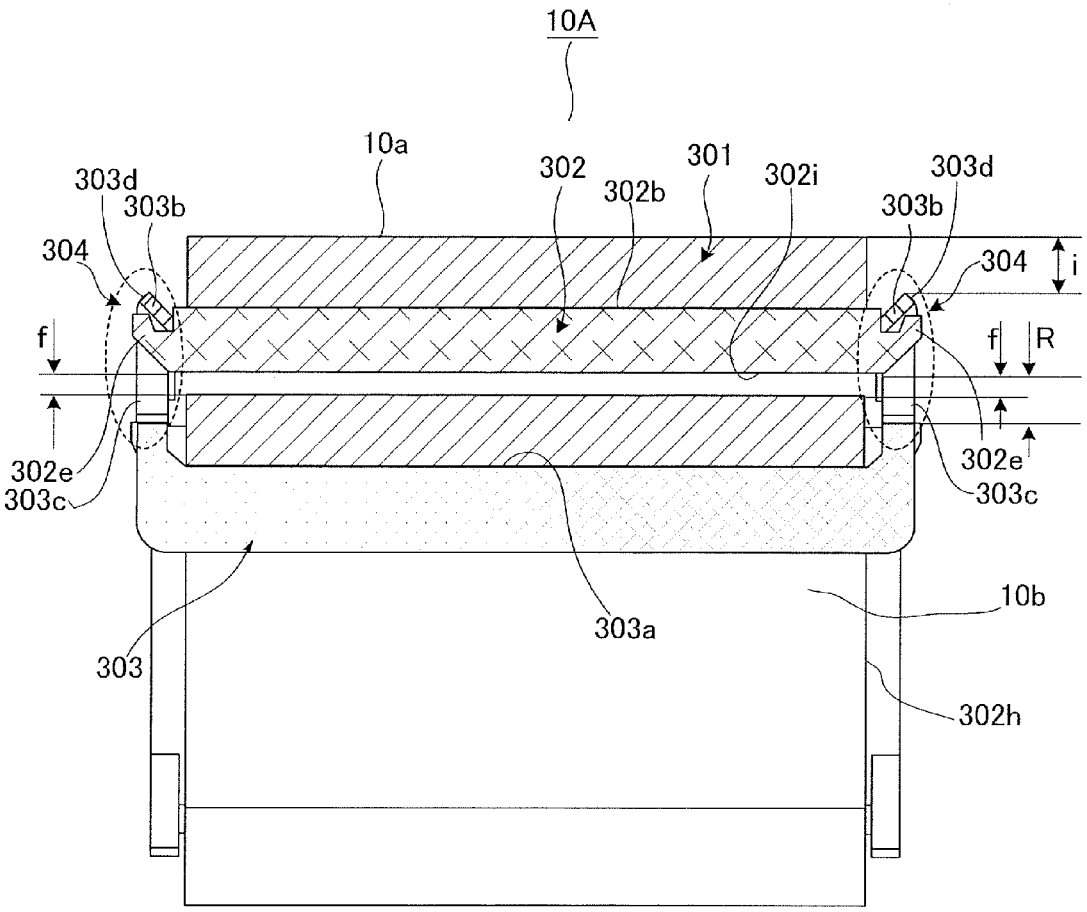
FIG. 6 is a section view illustrating the feed roller of the first embodiment taken along a line α-α in FIG. 4B.

As shown in FIGS. 5B and 5C, the roller core 302 includes a support portion 302*b* formed into a circular arc in section, capable of wrapping the rubber belt 301 around the outer circumference thereof, and supporting apart of the wrapped rubber belt 301 as the frictional conveying portion 10*a*. The rubber belt 301 abuts with and conveys the sheet S by a surface on a backside of the inner circumferential surface supported by the support portion 302*b*, that is, by the outer circumferential surface. It is noted that the support portion 302*b* may be formed substantially into a circular arc in section.

Still further, the roller core 302 has a concave portion 302*h* located at a back side of the support portion 302*b* such that a non-conveying belt portion 10*b*, as a region other than the frictional conveying portion 10*a* of the rubber belt 301, is positioned therein. The concave portion 302*h* is formed into a concave shape in section of a depth Dp so as to hold the non-conveying belt portion 10*b* therein in a state in which the roller core 302 is attached to the roller base 401. A bottom portion in a depth direction (vertical direction in FIG. 5B) of the concave portion 302*h* is formed as a back face portion 302*i* located at a back side of the support portion 302*b*.

The roller core 302 includes engage projections 302*d* and lock projections 302*e*, i.e., projections respectively projecting at widthwise both ends of the support portion 302*b*. The engage projections 302*d* are formed on an axial line in parallel with the axial center of the driving shaft 109 and are turnably engaged with lock portions 401*d* of the roller base 401 described later. The lock projection 302*e* is engageable with an engage opening 303*c*, i.e., a cavity portion formed through a projecting portion 303*b* (link portion) of the belt holder 303. Then, in a state in which the lock projection 302*e* is engaged with the engage opening 303c, a predetermined range of clearance (a range R shown in FIG. 6) is formed. The projecting portion 303*b* having the engage opening 303*c* and the lock projection 302e constitute the engage portion 304 (see FIG. 4A) engaging the roller base 401 with the belt holder 303. It is noted that a cavity portion may be formed into a concave shape being capable of movably engaged with a convex portion like the lock projection 302*e* in this embodiment.

The belt holder 303 is disposed at an inner side of the concave portion 302*h* to hold the non-conveying belt portion 10*b* of the rubber belt 301 within the concave portion 302*h* while resisting against the resilient force (elastic force) of the rubber belt 301. In a state in which the belt holder 303 is set into the concave portion 302*h* together with the non-conveying belt portion 10*b*, a gap f of a predetermined width is formed between the non-conveying belt portion 10*b* and a back face portion 302*i* of the support portion 302*b* as shown in FIG. 6. Then, the belt holder 303 is supported by the roller core 302 such that the belt holder 303 is slidable (movable) within a predetermined range (within the range R) while supporting the non-conveying belt portion 10*b* by resisting against the resilient force (elastic force) thereof. That is, the belt holder 303 is held at a hold position which is an intermediate position in a depth direction of the concave portion 302*h* by the roller core 302 and is restricted from moving to an opening side of the concave portion 302*h* by the resilient force of the rubber belt 301. Still further, the belt holder 303 is supported movably to the back face portion 302*i* within the range R when the feed roller 10A is attached to the roller base 401. As described later, the belt holder 303 moves from the hold position toward the back face portion 302*i* when the feed roller 10A is attached to the driving shaft 109. At this time, the belt holder 303 is attached to the roller base 401 by deforming the rubber belt 301 wrapped around the roller core 302 such that an elastic deformation volume of the rubber belt 301 increases. Then, the belt holder 303 limits the deformation volume of the rubber belt 301 to a certain volume (f) when the rubber belt 301 restores its natural form by the resilient force in accordance to the detachment operation of the feed roller 10A from the roller base 401.

Figure 5D:
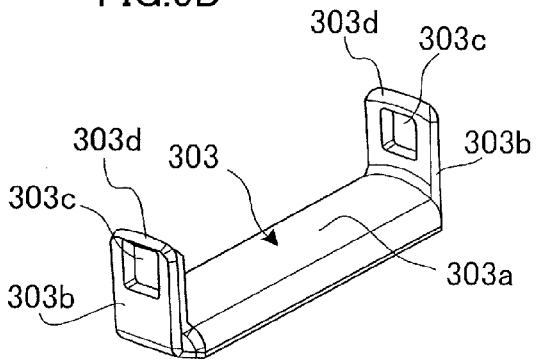
FIG. 5D is a perspective view illustrating a belt holder of the feed roller of the first embodiment.

As shown in FIGS. 5D and 6, the belt holder 303 includes a body portion 303*a* (contact portion) extending in a width direction orthogonal to a circumferential direction of the rubber belt 301, and the body portion 303*a* is in contact with an outer circumferential surface of the rubber belt 301. The belt holder 303 includes a projecting portion 303*b*, i.e., a first link, projecting from a first end portion of the lengthy body portion 303*a* in the depth direction (upper direction in FIG. 6) of the concave portion 302*h*, and a projecting portion 303*b*, i.e., a second link, projecting from a second end portion of the body portion 303*a* in the depth direction.

The projecting portions 303*b* are each formed with the engage opening 303*c* extending in a direction in which the belt holder 303 slides and being linked with the lock projection 302*e* of the roller core 302, respectively. That is, the projecting portions 303*b* of the belt holder 303, extending toward the inner circumferential side of the rubber belt 301 (in other words, toward the roller core 302) from the body portion 303*a* in contact with the outer circumferential surface of the rubber belt 301, are connected to the lock projection 302*e* while crossing over the rubber belt 301, respectively. Accordingly, the projecting portions 303*b* are parts being disposed at the positions sandwiching the rubber belt 301 from the both widthwise outer sides as shown in FIGS. 4A and 4B and partially overlapping with the rubber belt 301 by viewing in a direction of a rotation axial line of the feed roller 10A (view point in FIG. 4B). Still further, as shown in FIGS. 4A and 6, the gap f is provided at the engage portion 304 between the roller core 302 and the belt holder 303 so that the belt holder 303 can move in a direction of an arrow G.

Figure 5E:
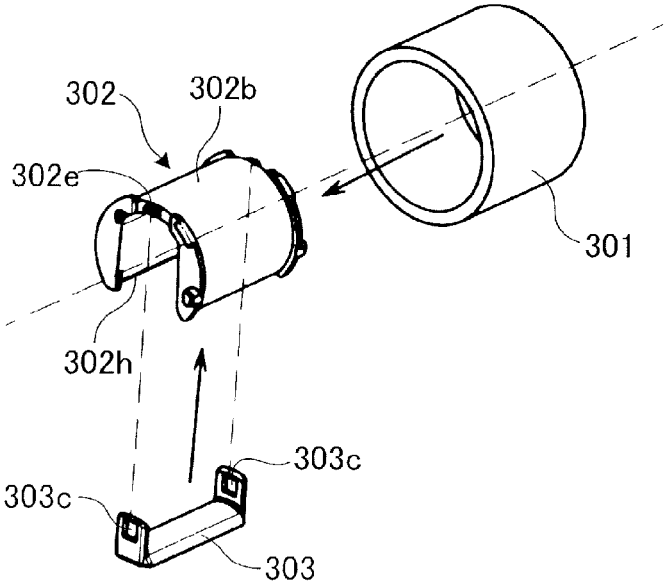
FIG. 5E is an exploded perspective view illustrating an assembly process of the feed roller of the first embodiment.

As shown in FIGS. 4A and 4B and FIGS. 5A through 5D, the rubber belt 301 is attached to the support portion 302*b* of the roller core 302 so as to run along the outer circumference thereof. The rubber belt 301 is held by the belt holder 303 attached to the roller core 302 such that the rubber belt 301 does not fall from the roller core 302 by its resilient force (elastic force). That is, as shown in FIG. 5E, the rubber belt 301 is wrapped to the roller core 302 as in the cylindrical shape in the first step, and the belt holder 303 is attached to the roller core 302 in the next step. The feed roller 10A is assembled in this way and become attachable to the driving shaft 109. When the operator attaches the belt holder 303 to the roller core 302, the body portion 303*a* of the belt holder 303 presses the outer circumferential surface of the rubber belt 301 to push the non-conveying belt portion 10*b* into the concave portion 302*h* while deforming elastically.

In the present embodiment, an inner circumferential length d1 of the rubber belt 301 (FIG. 5A) is set to be smaller than an outer circumferential length d2 of the roller core 302 (FIG. 5B) (in short, d1<d2). The inner circumferential length d1 is an entire length along an inner circumferential direction of the inner circumferential surface of the rubber belt 301. The outer circumferential length d2 is a length in which an entire length along an outer circumferential direction of the support portion 302*b* is added with an entire length along an inner circumferential direction of the concave portion 302*h* of the roller core 302.

As shown in FIGS. 5C and 6, the lock projection 302*e* is formed so as to incline upward to the front side so that the lock projection 302*e* can smoothly engage with the engage opening 303*c* of the projecting portion 303*b* to be slipped in and engaged from underneath. The projecting portion 303*b* of the belt holder 303 is configured to be slightly opened to the outside in the width direction of the roller core 302 by deflection of the body portion 303*a* and/or the projecting portion 303*b*, so that the belt holder 303 is able to be smoothly engaged with the lock projection 302*e* projecting in the width direction of the roller core 302.

The sheet feeding apparatus 100 also includes a roller base 401 (see FIGS. 7A and 7B), i.e., a roller attaching portion, fixed to the driving shaft 109 and removably holding the feed roller 10A to the driving shaft 109. The roller base 401 of the present embodiment is configured to receive the resilient force of the rubber belt 301 in the state in which the feed roller 10A is attached through the belt holder 303 and the driving shaft 109.

Thus, the rubber belt 301, being attached to the roller core 302 and in close contact with the outer circumferential surface of the support portion 302*b*, is kept in a state in which the resilient force acts to push down the belt holder 303 in a direction of an arrow H in FIG. 4A. It is noted that in the present embodiment, an outer diameter d3 (see FIG. 4B) of the feed roller 10A is equalized with an inner diameter d4 (see FIG. 5A) of the rubber belt 301, e.g., 30 mm. However, their diameters are not limited to those values, and the inner diameter d4 of the rubber belt 301 may be greater than the outer diameter d3 of the roller core 302 as long as its inner circumferential length d1 does not exceed the outer circumferential length d2 of the roller core 302.

Figure 7A:
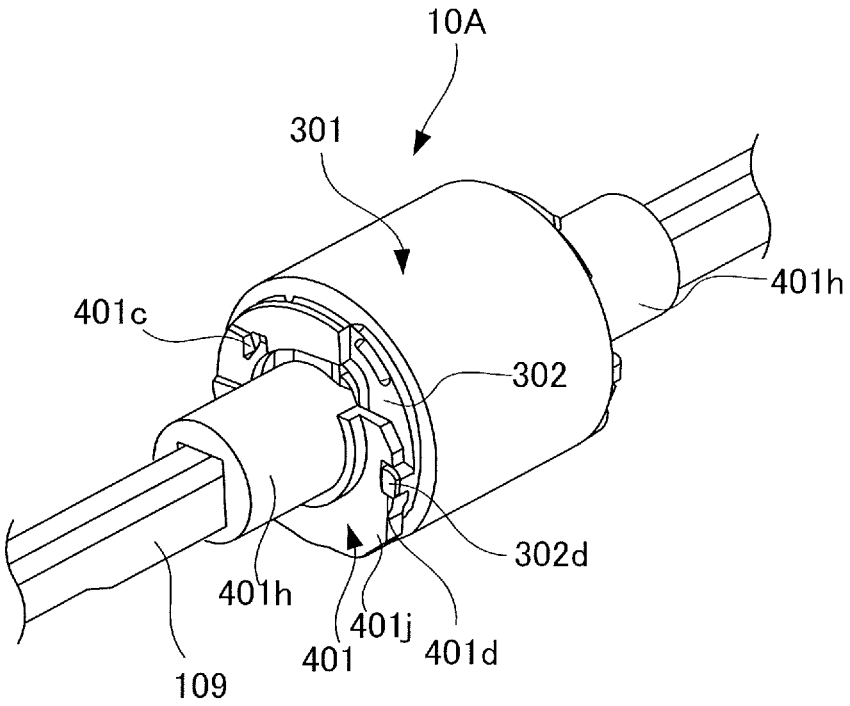
FIG. 7A is a perspective view illustrating a state in which the feed roller of the first embodiment is attached to the driving shaft.
Figure 7B:
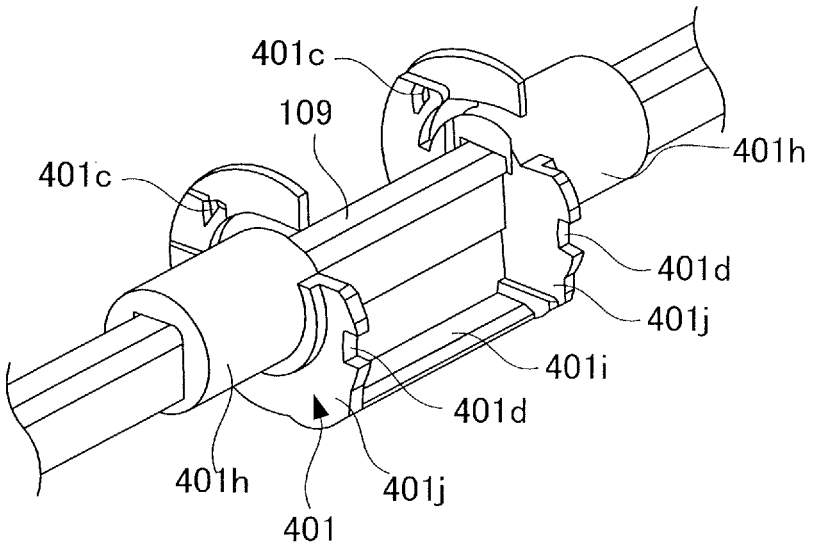
FIG. 7B is a perspective view illustrating a state in which the feed roller of the first embodiment is detached from the driving shaft.
Figure 8A:
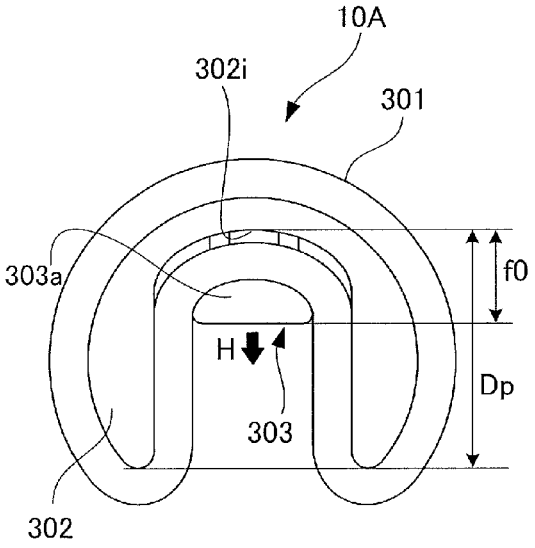
FIG. 8A is a section view illustrating a state in which the feed roller of the first embodiment is detached from the driving shaft.
Figure 8B:
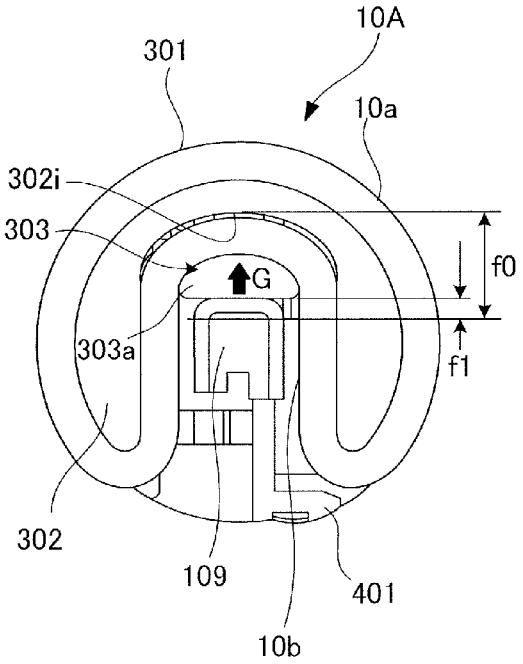
FIG. 8B is a section view illustrating a state in which the feed roller of the first embodiment is attached to the driving shaft.
Figure 9A:
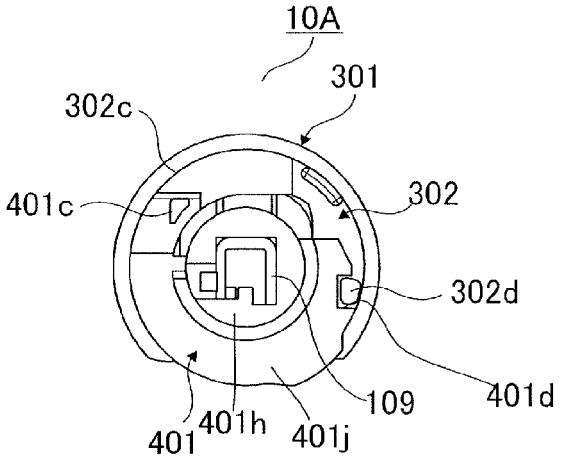
FIG. 9A illustrates a state in which the feed roller of the first embodiment is attached to the driving shaft.
Figure 9B:
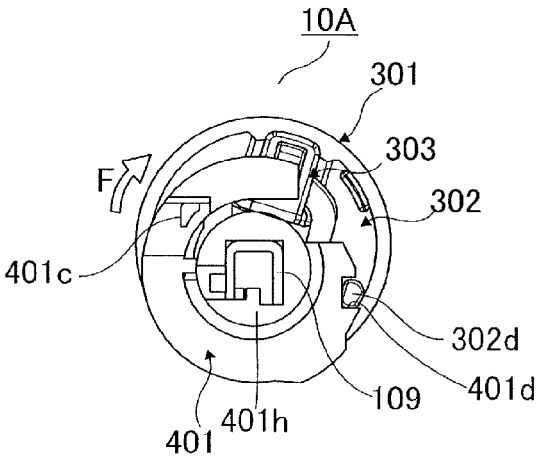
FIG. 9B illustrates a state in which the feed roller of the first embodiment is unlocked from a lock portion of the roller base.
Figure 9C:
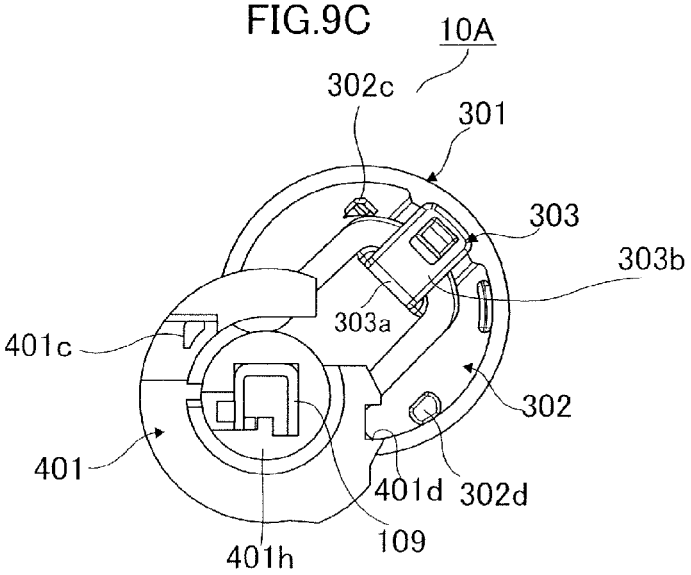
FIG. 9C illustrates a state in which the feed roller of the first embodiment is detached from the driving shaft.

Next, a replacing operation of the feed roller 10A will be described with reference to FIGS. 7A through 9C. It is noted that FIG. 7A is a perspective view illustrating a state in which the feed roller 10A is attached to the driving shaft 109 and FIG. 7B is a perspective view illustrating a state in which the feed roller 10A is removed from the driving shaft 109. FIG. 8A is a section view illustrating the feed roller 10A in a state in which the feed roller 10A is detached from the driving shaft 109 and taken at an axial center part thereof, and FIG. 8B is a section view illustrating the feed roller 10A in a state in which the feed roller 10A is attached to the driving shaft 109 and taken at the axial center part thereof. FIGS. 9A through 9C are front views illustrating stepwise states from the state in which the feed roller 10A is attached to the roller base 401 until when it is removed.

The resin-made roller base 401 fixed to the driving shaft 109 includes a pair of cylindrical portions 401*h* (see also FIG. 2) fixed substantially at an axial center part of the driving shaft 109 formed into a rectangular shape in section as shown in FIGS. 7A, and 7B and FIGS. 8A and 8B. The roller base 401 includes a roller holding portion 401*i* formed between the pair of cylindrical portions 401*h*. The roller base 401 also includes flange portions 401*j* bent orthogonally to the cylindrical portions 401*h* at both ends of the roller holding portion 401*i*. Each of the flange portions 401*j* is provided with a snap fit 401*c* and a concave lock portion

401*d* dented radially inside from an outer circumferential part of the flange portion 401*j*, respectively.

The feed roller 10A is attached as follows to the roller base 401 constructed as described above. That is, the feed roller 10A is turned counterclockwise from a state shown in FIG. 9B with respect to the roller base 401 centering on the engage projection 302*d* in a state in which the engage projection 302*d* of the roller core 302 is hooked to the lock portion 401*d* of the roller base 401 (see FIG. 9B). Then, the feed roller 10A is attached to the roller base 401 as shown in FIG. 9A by hooking the hook 302*c* (engage portion) of the roller core 302 to the snap fit 401*c* (engaged portion) of the roller base 401. That is, the hook 302*c* and the snap fit 401*c* constitute a snap fit mechanism enabling to lock the feed roller 10A to the roller base 401.

In this attachment state, the belt holder 303 is pressed in a direction of an arrow G as shown in FIGS. 8A and 8B by the driving shaft 109 while resisting against the resilient force of the non-conveying belt portion 10*b* pushed into the back face portion 302*i* side by the belt holder 303 on the concave portion 302*h* (FIG. 6) side. That is, in a state before the attachment, the belt holder 303 is located at a hold position where a surface thereof facing the driving shaft 109 is separated from the back face portion 302*i* of the roller core 302 by a predetermined distance f0 which is smaller than the depth Dp of the concave portion 302*h* (FIG. 8A). In a state in which the feed roller 10A is attached to the driving shaft 109, the belt holder 303 is positioned by being moved in the direction of the arrow G from the hold position (FIG. 8B) within a range of being allowed by the gap f. That is, an elastic deformation volume of the rubber belt 301 in a state in which the hook 302*c* is engaged with the snap fit 401*c* is greater than an elastic deformation volume in a state in which the hook 302*c* is not engaged with the snap fit 401*c*. Then, the feed roller 10A is put into a state in which the feed roller 10A continuously applies the resilient force to the driving shaft 109 by tensile force of the rubber belt 301 (FIG. 8B). It is noted that the distance in which the belt holder 303 is movable by the gap f is set at 0.5 mm in this embodiment for example.

In a case when the operator takes the feed roller 10A in an attached state shown in FIG. 9A out of the roller base 401 on the other hand, the operator disengages the snap fit 401*c* by pulling to a front side in FIG. 9A for example. Thereby, the belt holder 303 is pushed back in the direction of the arrow H shown in FIG. 8A by the gap f by the resilient force of the rubber belt 301, and the feed roller 10A pops up while slightly turning in a direction of an arrow F as shown in FIG. 9B. Therefore, the operator can readily take the feed roller 10A out of the roller base 401. That is, the feed roller 10A is detached from the driving shaft 109 and taken out of the roller base 401 as shown in FIG. 9C. Accordingly, the operation for replacing the feed roller 10A can be simply carried out.

In this case, it is possible to adequately adjust the resilient force of the rubber belt 301 by adjusting the inner circumferential length d1 of the rubber belt 301 shown in FIG. 5A and/or the moving distance, due to the gap f, of the belt holder 303 with respect to the roller core 302. It is then possible to avoid such problems that a jump-out amount (pop-out amount) of the feed roller 10A is too small, making it difficult to take out the feed roller 10A, and that the feed roller 10A jumps out too much and falls down in taking the feed roller 10A out of the driving shaft 109, by adjusting the resilient force as described above.

Then, the belt holder 303 is configured such that the belt holder 303 abuts with the outer circumferential surface of the rubber belt 301 to hold in the concave portion 302*h* of the roller core 302 in the state in which the feed roller 10A is detached from the driving shaft 109. Due to that, it is possible to prevent the rubber belt 301 from falling out of the roller core 302 in taking the feed roller 10A out of the roller base 401.

Still further, the belt holder 303 removable with respect to the roller core 302 is attached to the roller core 302 after wrapping the rubber belt 301 around the roller core 302. Therefore, when an operator assembles the feed roller 10A, in replacing the rubber belt 301 for example, he/she takes sequential steps of wrapping a cylindrical rubber belt 301 around the roller core 302 and of attaching the belt holder 303 to the roller core 302 while holding and pressing the belt holder 303 to the rubber belt 301. This arrangement makes it possible to simply assemble the feed roller 10A as compared to one required to assemble the rubber belt 301 with a holding member while manually deforming the rubber belt largely in advance. Still further, it is possible to readily take the rubber belt 301 out of the roller core 302 because the rubber belt 301 restores its cylindrical shape by taking the belt holder 303 out of the roller core 302.

Figure 10A:
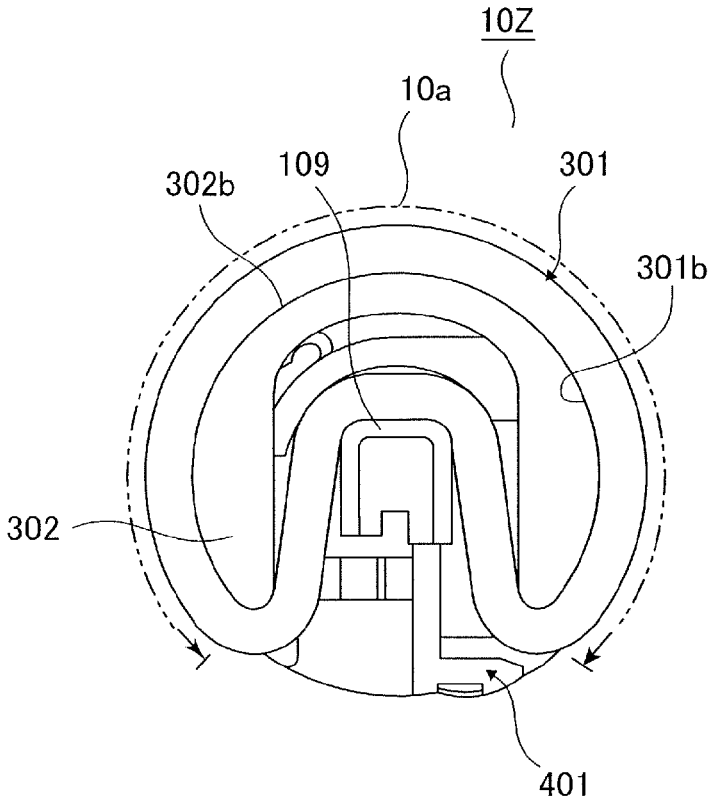
FIG. 10A illustrates a state in which a feed roller configured without applying the invention is attached to a driving shaft.
Figure 10B:
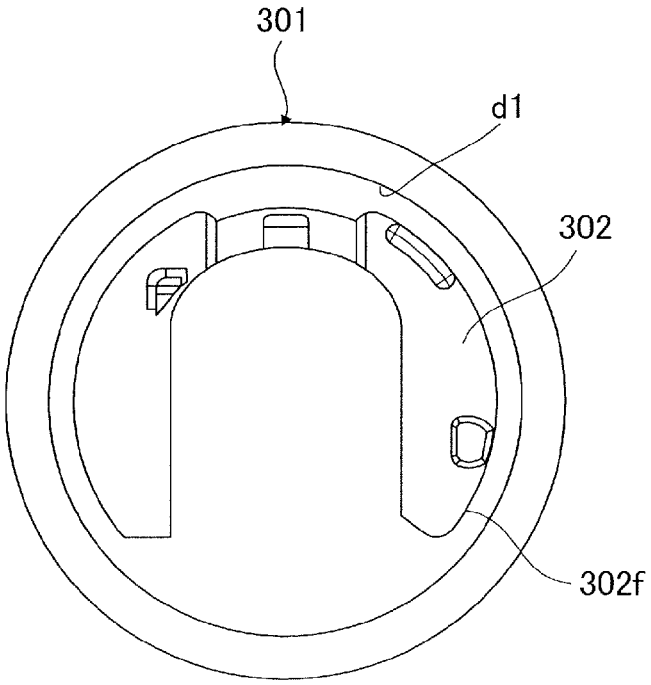
FIG. 10B illustrates a state in which the feed roller shown in FIG. 10A is detached from the driving shaft.
Figure 11:
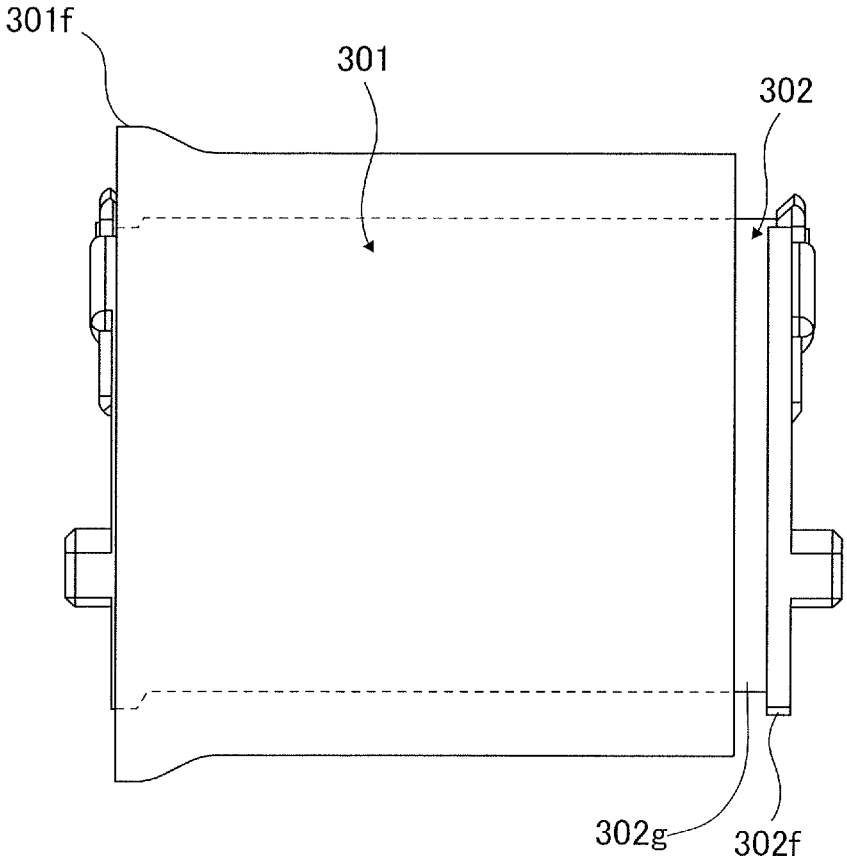
FIG. 11 illustrates erroneous attachment of the feed roller.

Here, a feed roller 10Z, i.e., a comparative example, configured to include no belt holder 303 of the present embodiment will be described with reference to FIGS. 10A and 10B and FIG. 11. It is noted that FIG. 10A is a section view illustrating a state in which the feed roller 10Z is attached to the driving shaft 109 without the belt holder 303. FIG. 10B is a section view illustrating a state in which the feed roller 10Z shown in FIG. 10A is removed out of the driving shaft 109. FIG. 11 illustrates erroneous attachment in which the feed roller 10Z is attached in a state in which an edge of the elastic belt member overrides the flange portion 302*f*.

The feed roller 10A of the present embodiment is configured to prolong the frictional conveying portion 10*a* indicated by a two-dot chain line to prolong a conveying distance of one rotation thereof (see FIG. 5B). Therefore, the inner circumferential length d1 of the rubber belt 301 is greater than an outer diameter of the flange portion 302*f* of the roller core 302 as shown in FIG. 10B in the configuration including no belt holder 303.

Therefore, in the state of FIG. 10B in which the feed roller 10Z is not attached to the roller base 401, there is a possibility that the rubber belt 301 deviates from the roller core 302. Or, as shown in FIG. 11, there is a possibility that the edge 301*f* of the rubber belt 301 is erroneously attached at position deviating from a predetermined position by being attached in a state in which the edge 301*f* overrides the flange portion 302*f* provided at the both ends of the roller core 302.

In contrast, the feed roller 10A of the present embodiment can be set in the state in which movement of the rubber belt 301 located in the concave portion 302*h* is limited within the range of the gap f by the belt holder 303 assembled to the roller core 302.

Therefore, the rubber belt 301 hardly drops out of the roller core 302 in a state in which the feed roller 10A is not attached to the roller base 401. Still further, the feed roller 10A is prevented from being incorrectly attached to the roller base 401 in the state in which the rubber belt 301 overrides the flange portion 302*f*. This arrangement makes it possible to avoid the abovementioned troubles even if the support portion 302*b* of the roller core 302 is formed into a circular arc having a central angle of more than 180 degrees. It is noted that while the support portion 302*b* of the present embodiment is formed into a circular arc having a central angle of around 270 degrees as shown in FIG. 5B, the degree of the central angle can be changed appropriately by taking size of the sheet S, a distance between the feed roller 10A and the conveying roller pair 13 or the like into consideration for example.

Still further, the projecting portions 303*b* of the belt holder 303 are positioned at the both widthwise ends with respect to the rubber belt 301 and are located at the positions overlapping with the rubber belt 301 in frontal view (see FIG. 4B). Therefore, it is possible to restrict the rubber belt 301 from moving in the axial direction thereof and to prevent the erroneous attachment of the rubber belt 301 more reliably.

If the inner diameter of the rubber belt 301 is reduced to prevent the rubber belt 301 from deviating out of the roller core 302, like the prior art, a deformation volume (extension rate) of the rubber belt 301 in attaching the feed roller 10Z to the roller base 401 will increase. Then, if the snap fit 401*c* is unlocked, the resilient force generated by the rubber belt 301 in returning to a natural state (cylindrical shape) from the largely elastically deformed state acts on the feed roller 10Z, so that the resilient force of the rubber belt 301 increases too much. Due to that, there is a possibility that the feed roller 10Z pops up vigorously out of the driving shaft 109 beyond expectation of the operator and falls down.

Accordingly, it is possible to solve the abovementioned problems and the feed roller 10A can be readily taken out of the driving shaft 109 in replacing the rubber belt 301 by arranging such that the resilient force of the rubber belt 301 is limited by the belt holder 303 like the present embodiment. Then, it is possible to prevent the rubber belt 301 from dropping out of the roller core 302 or being incorrectly attached to the roller core 302 while overriding the flange portion 302*f*, and hence to improve the operability.

The arrangement of the present embodiment also makes it possible to adjust the pop-up amount of the feed roller 10A and to keep the pop-up amount in taking the feed roller 10A out of the roller base 401 to an adequate range by limiting the resilient force in taking out the feed roller 10A. Therefore, it is possible to avoid such troubles that the feed roller 10A otherwise jumps out and falls down in removing the feed roller 10A. Then, it is also possible to prevent the rubber belt 301 from falling out of the roller core 302 in taking the feed roller 10A out of the roller base 401, to prevent the erroneous attachment in attaching the feed roller 10A, and to improve the replaceability of the feed roller 10A.

<Modified Example>

Figure 12A:
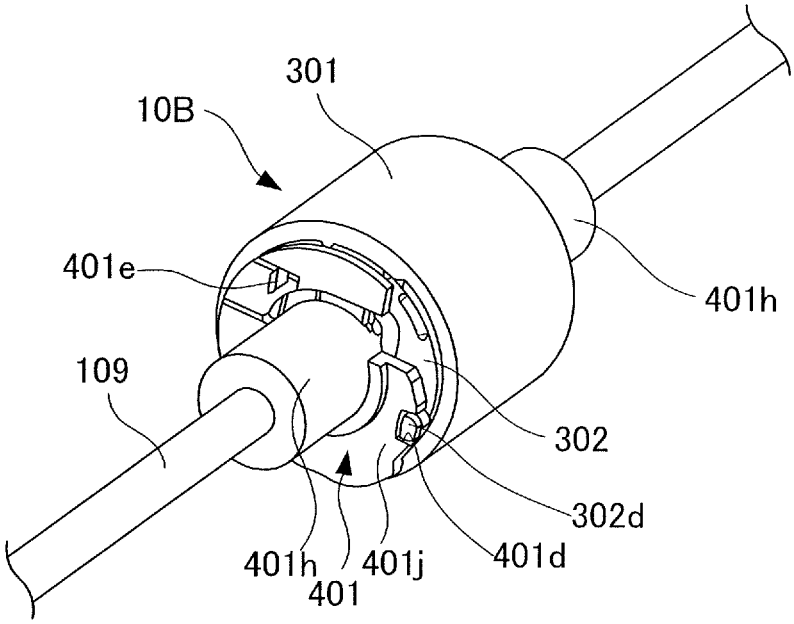
FIG. 12A is a perspective view illustrating a feed roller of a modified example of the first embodiment.
Figure 12B:
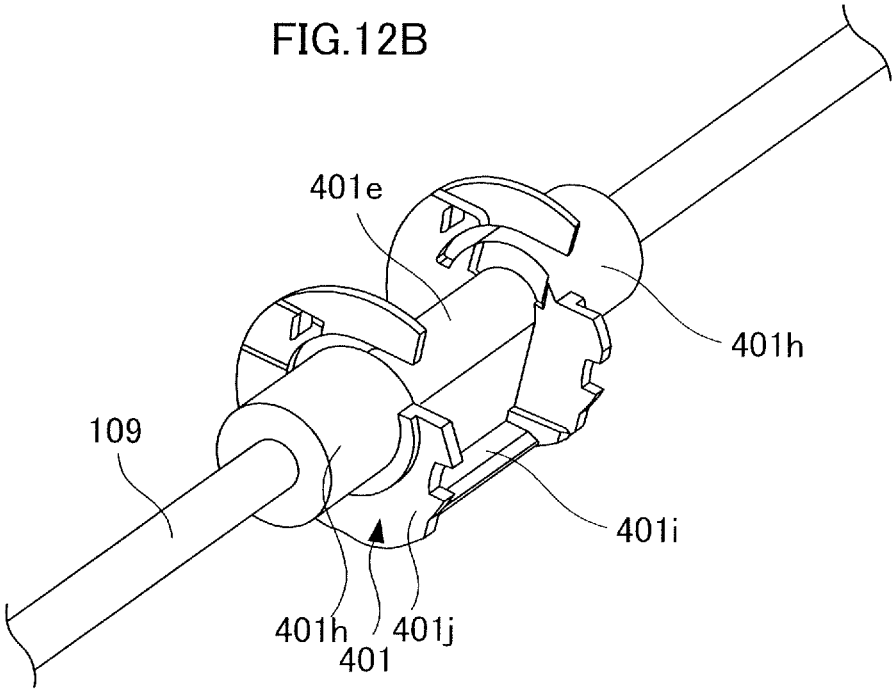
FIG. 12B is a perspective view illustrating a state in which the feed roller of the modified example of the first embodiment is detached from the driving shaft.
Figure 13:
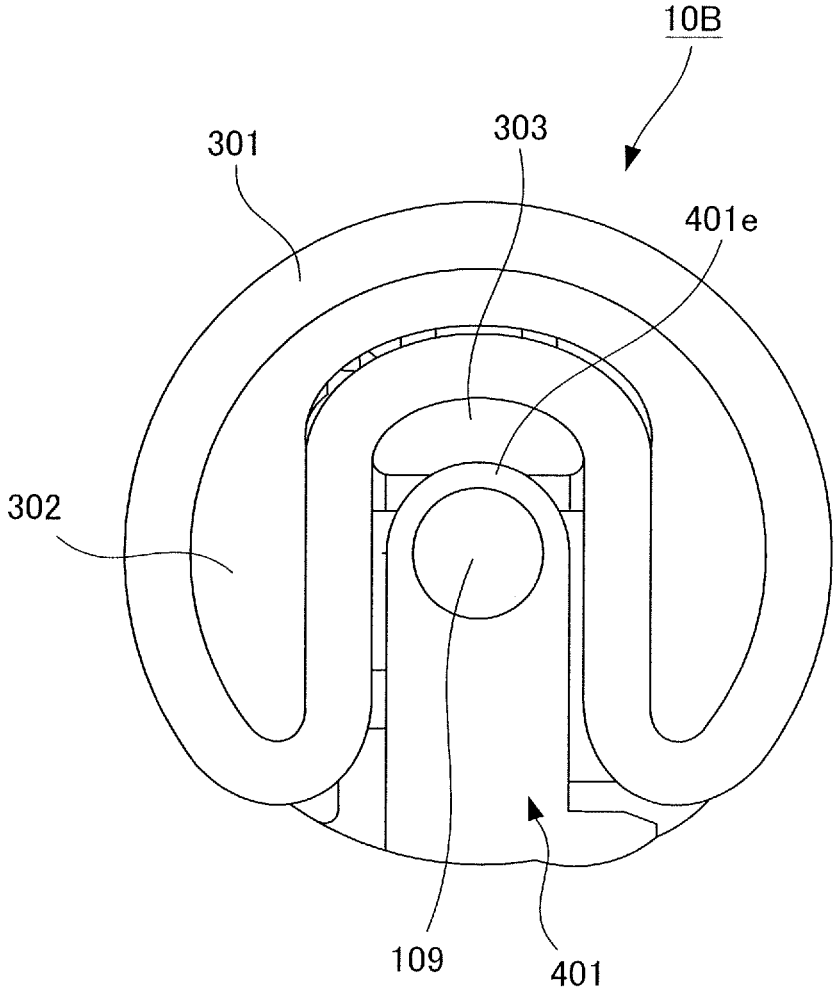
FIG. 13 is a section view illustrating the feed roller of the modified example of the first embodiment.

Next, a modified example of the first embodiment will be described with reference to FIGS. 12A and 12B and FIG. 13. It is noted that FIGS. 12A and 12B are perspective views illustrating a feed roller 10B of the modified example, and FIG. 13 is a section view of the feed roller 10B of the modified example taken along an axial center part thereof.

The first embodiment described above is arranged such that the position of the belt holder 303 with respect to the driving shaft 109 is determined by being pressed by the driving shaft 109 when the feed roller 10A is attached to the driving shaft 109. In contrary, according to the modified example, the position of the belt holder 303 is determined by a press portion 401*e* provided in the roller base 401 as shown in FIGS. 12A and 12B and FIG. 13 when the feed roller 10B is attached to the driving shaft 109.

Differing from the rectangular columnar driving shaft 109 as described above and shown in FIGS. 7A and 7B, the driving shaft 109 of the modified example is formed into a columnar shape. The roller base 401 of the modified example includes a cylindrical portion 401*h* having a shape corresponding to the columnar driving shaft 109 and the press portion 401*e* between the both flange portions 401*j* so as to cover the columnar driving shaft 109. It is possible to determine the position of the belt holder 303 with respect to the driving shaft 109 through the press portion 401*e* in the modified example. This arrangement also makes it possible to obtain the similar effects with the first embodiment.

<Second Embodiment>

Figure 14A:
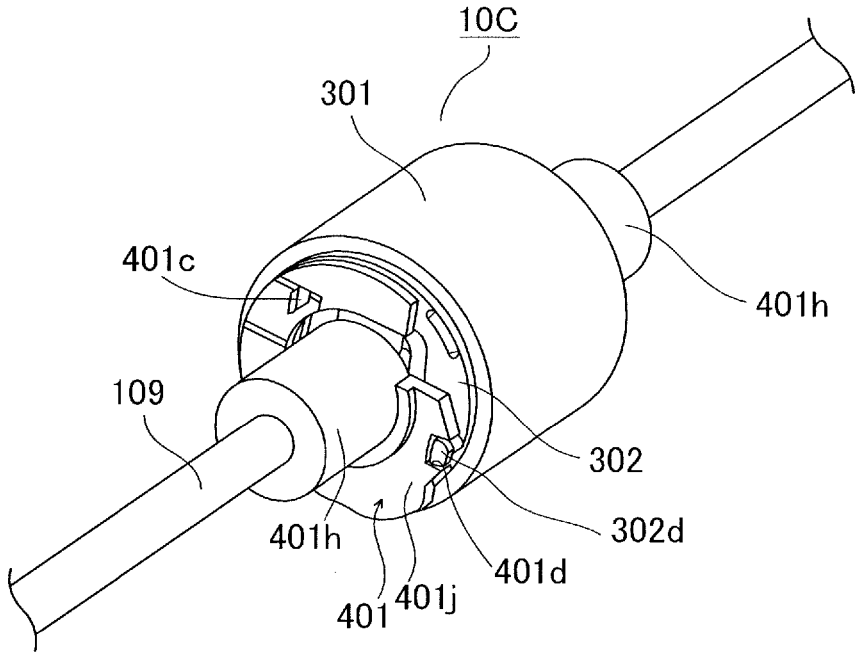
FIG. 14A is a perspective view illustrating a state in which a feed roller of a sheet feeding apparatus of a second embodiment is attached to a driving shaft.
Figure 14B:
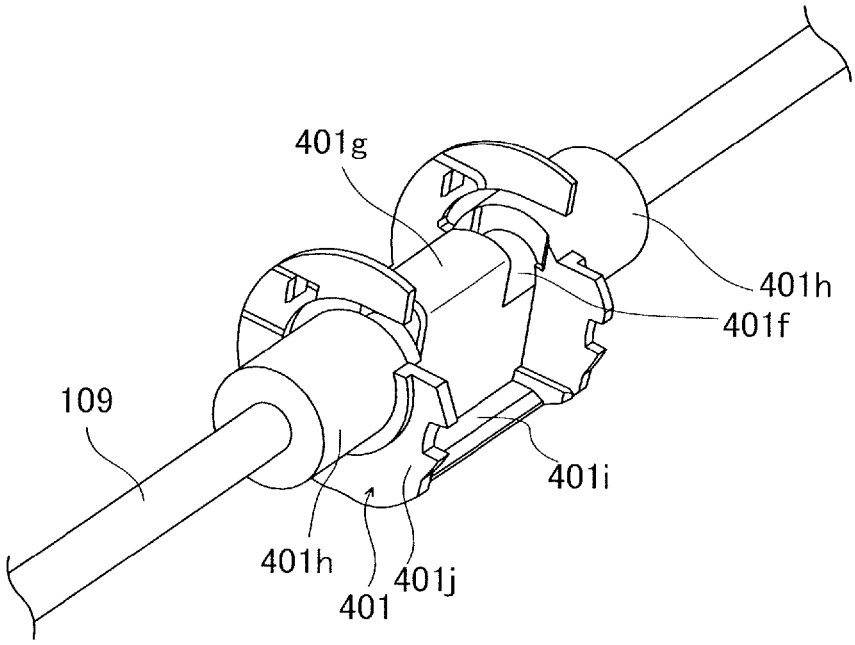
FIG. 14B is a perspective view illustrating a state in which the feed roller of the second embodiment is detached from the driving shaft.
Figure 15:
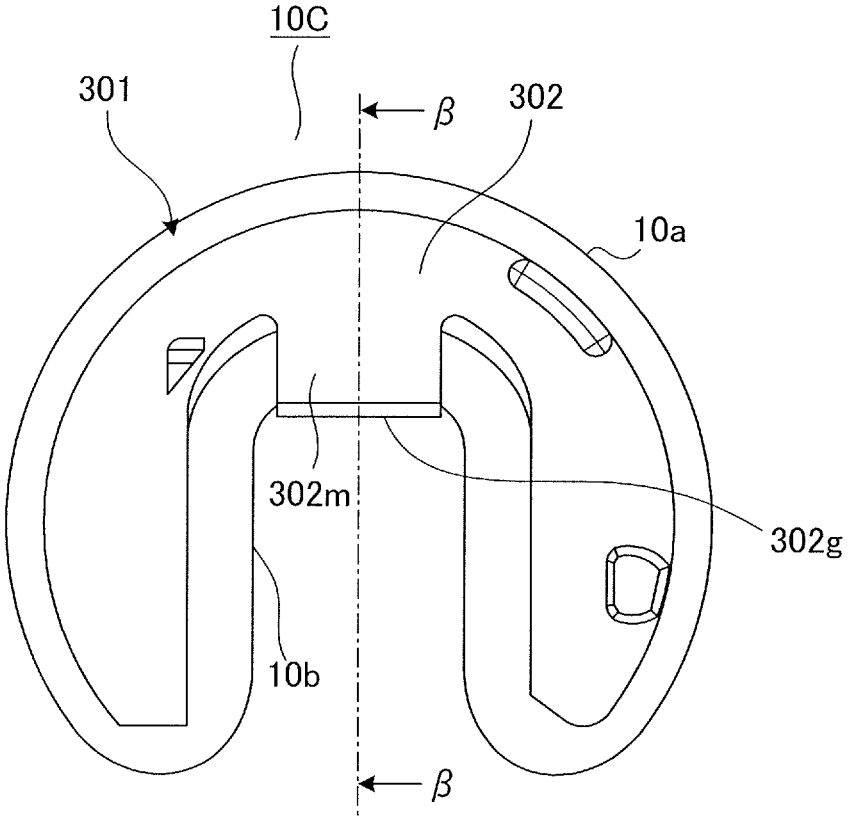
FIG. 15 is a front view illustrating the feed roller of the second embodiment.
Figure 16:
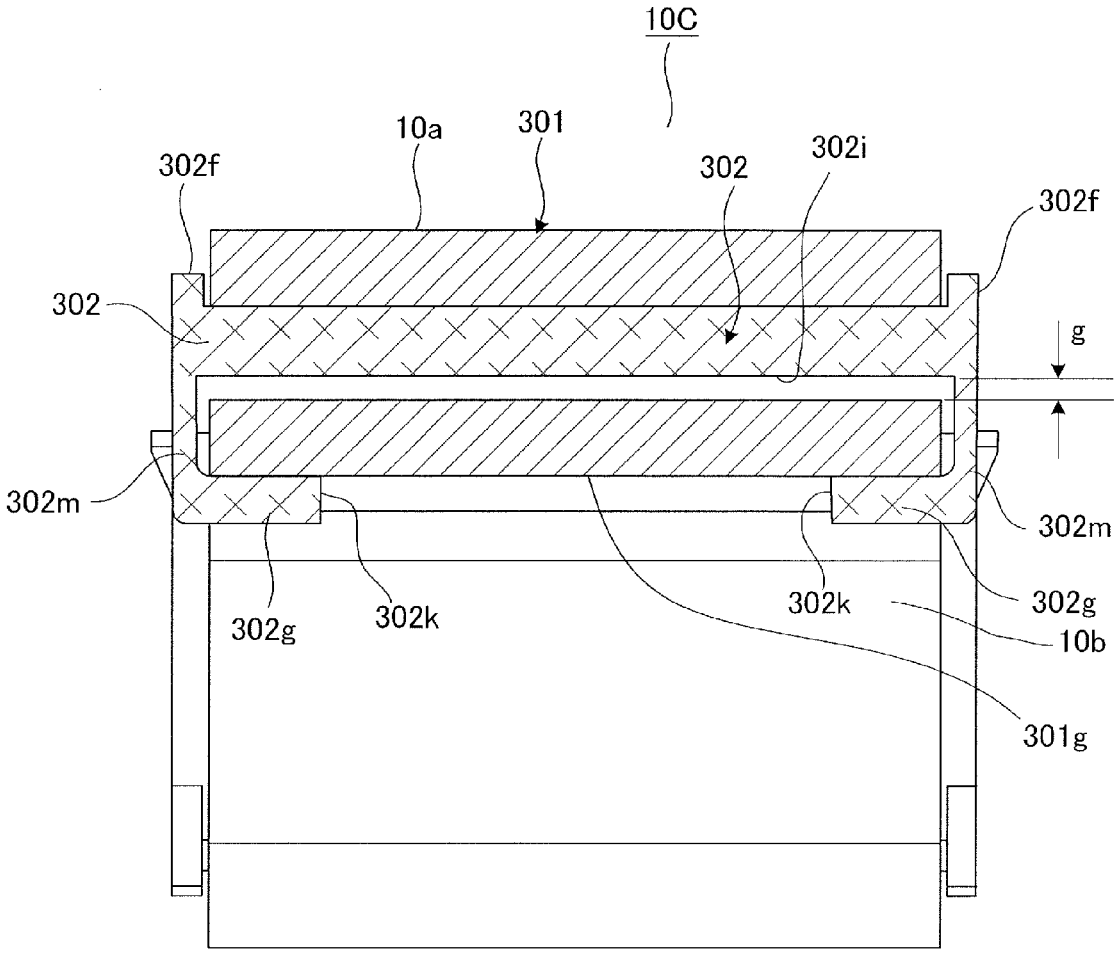
FIG. 16 is a section view illustrating the feed roller of the second embodiment taken along a line β-β in FIG. 15.
Figure 17A:
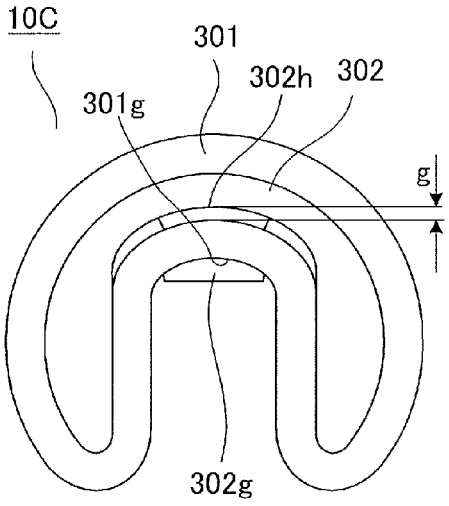
FIG. 17A is a section view illustrating a state in which the feed roller of the sheet feeding apparatus of the second embodiment is detached from the driving shaft.
Figure 17B:
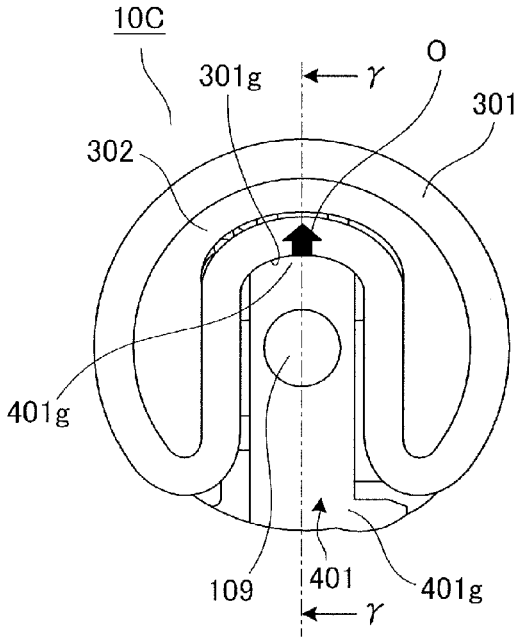
FIG. 17B is a section view illustrating a state in which the feed roller of the second embodiment is attached to the driving shaft.
Figure 18:
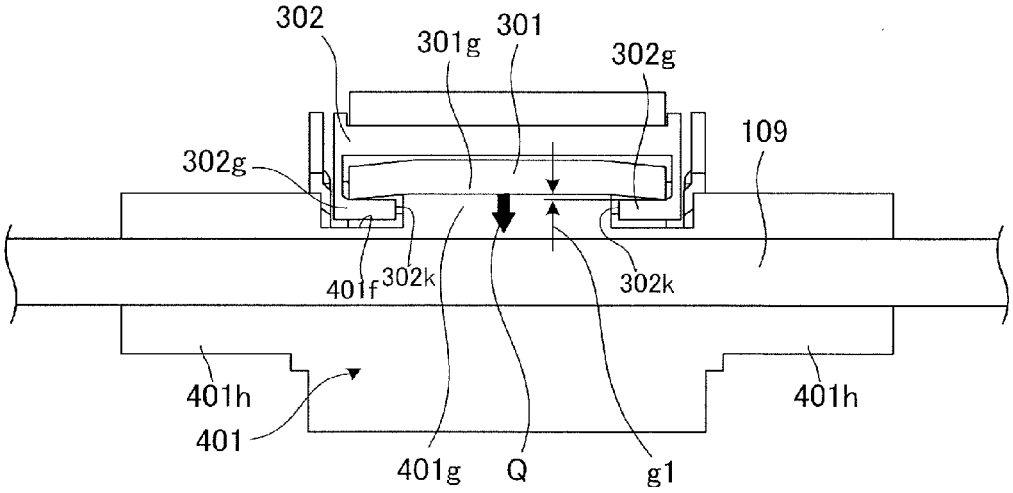
FIG. 18 is a section view illustrating the feed roller of the sheet feeding apparatus of the second embodiment.

Next, a second embodiment will be described with reference to FIGS. 14 through 18. It is noted that FIG. 14A is a perspective view illustrating a state in which a feed roller 10C (roller member) is attached to the driving shaft 109. FIG. 14B is a perspective view illustrating a state in which the feed roller 10C is detached from the driving shaft 109. FIG. 15 is a front view illustrating the feed roller 10C in the state in which the feed roller 10C is detached from the driving shaft 109. FIG. 16 is a section view illustrating the feed roller taken along a line β-β in FIG. 15. FIG. 17A is a section view illustrating the state in which the feed roller 10C is detached from the driving shaft 109. FIG. 17B is a section view illustrating the state in which the feed roller 10C is attached to the driving shaft 109. FIG. 18 is a section view illustrating the feed roller 10C take along a line γ-γ in FIG. 17B.

The first embodiment described above has the configuration of holding the rubber belt 301 of the feed roller 10A to the roller core 302 by using the belt holder 303. In contrast to that, the present embodiment is arranged such that the outer circumferential surface of the rubber belt 301 of the feed roller 10C is held by a belt holding portion 302*g* provided in the roller core 302 as shown in FIG. 15. That is, according to the present embodiment, a first holding portion (support portion 302*b*) holding an inner circumferential surface of the rubber belt 301 and a second holding portion (belt holding portion 302*g*) holding the outer circumferential surface of the rubber belt 301 are integrally formed. It is noted that in the present embodiment, the same or corresponding components having the same configurations and functions with those of the first embodiment will be denoted by the same reference numerals and an explanation thereof will be omitted here.

The roller core 302 is provided with the belt holding portion 302*g* capable of holding the non-conveying belt portion 10*b* while keeping a predetermined distance (gap g) between the non-conveying belt portion 10*b* and a back face portion 302*i* of the support portion 302*b* in the state in which the feed roller 10C is taken off. That is, as shown in FIGS. 15 and 16, the belt holding portion 302*g* is provided integrally with the roller core 302 so as to hold the non-conveying belt portion 10*b* by resisting against the resilient force of the rubber belt 301 while keeping the predetermined distance (gap g) from the back face portion 302*i*.

The belt holding portions 302*g* are supported by supporting arms 302*m* projecting in the depth direction of the concave portion 302*h* of the roller core 302 from both end portions, in the width direction orthogonal to the circumferential direction of the rubber belt 301, of the support portion 302*b*. The belt holding portion 302*g* protruding like a hook at an edge of the supporting arm 302*m* comes into contact with the outer circumferential surface of the rubber belt 301 at a surface facing the bottom of the concave portion 302*h* and holds the widthwise both ends of the non-conveying belt portion 10*b* by resisting against the resilient force of the rubber belt 301.

When the feed roller 10C is attached to the roller base 401, i.e., a roller attaching portion, the concave region 301*g* of the rubber belt 301 shown in FIGS. 16 and 17B is positioned as follows. That is, the concave region 301*g* of the rubber belt 301 is positioned by being lifted by a convex portion 401*g* formed on the roller holding portion 401*i* shown in FIG. 14B by a moving distance corresponding to the gap g in a direction of an arrow O as shown in FIG. 17B.

Thus, the convex portion 401*g* of the roller base 401 projects upward in FIG. 18 between end portions 302*k* of the belt holding portion 302*g* corresponding to the both end portions of the non-conveying belt portion 10*b*, and pushes up the widthwise center portion of the non-conveying belt portion 10*b*. Thereby, the roller base 401 receives the resilient force of the rubber belt 301 through the convex portion 401*g* in the state in which the feed roller 10C is attached. Concave portions 401*f* avoiding the belt holding portion 302*g* when the convex portion 401*g* enters between the end portions 302*k* of the belt holding portion 302*g* are formed at both ends of the convex portion 401*g* as shown in FIGS. 14B and 18.

In the present embodiment constructed as described above, the feed roller 10C is held in a state in which the resilient force in a direction of an arrow Q is added to the convex portion 401*g* of the roller base 401 by the tensile force of the rubber belt 301 as shown in FIG. 18. Therefore, if the snap fit 401*c* (see FIG. 14A) of the roller base 401 is unlocked, the feed roller 10C pops up out of the roller base 401 by the tensile force of the rubber belt 301. It is possible to control this pop-up amount by adjusting the moving distance based on the gap g in advance.

It is possible to obtain the similar advantageous effects with the first embodiment by constructing as described above. That is, it is possible to facilitate the removal of the feed roller 10C in replacing the feed roller 10C, to prevent the erroneous attachment from occurring in attaching the feed roller 10C, and to improve the workability. Still further, because there is no belt holder 303 as compared to the configuration of the first embodiment, it is possible to cut a number of components and to simplify the configuration of the unit. Still further, it is possible to avoid such erroneous attachment that the rubber belt 301 deviates out of the roller core 302 and that the rubber belt 301 overrides the flange portion 302*f* of the roller core 302.

It is noted that the second embodiment is configured such that the concave region 301*g* of the rubber belt 301 is pushed up by the moving distance corresponding to the gap g by the convex portion 401*g* of the roller base 401. However, instead of that, it is also possible to arrange such that the rubber belt 301 is pushed up by the moving distance corresponding to the gap g by forming a part pushing up the rubber belt 301 on the driving shaft 109 itself or at a region other than the convex portion 401*g* of the roller base 401.

<Third Embodiment>

Figure 19:
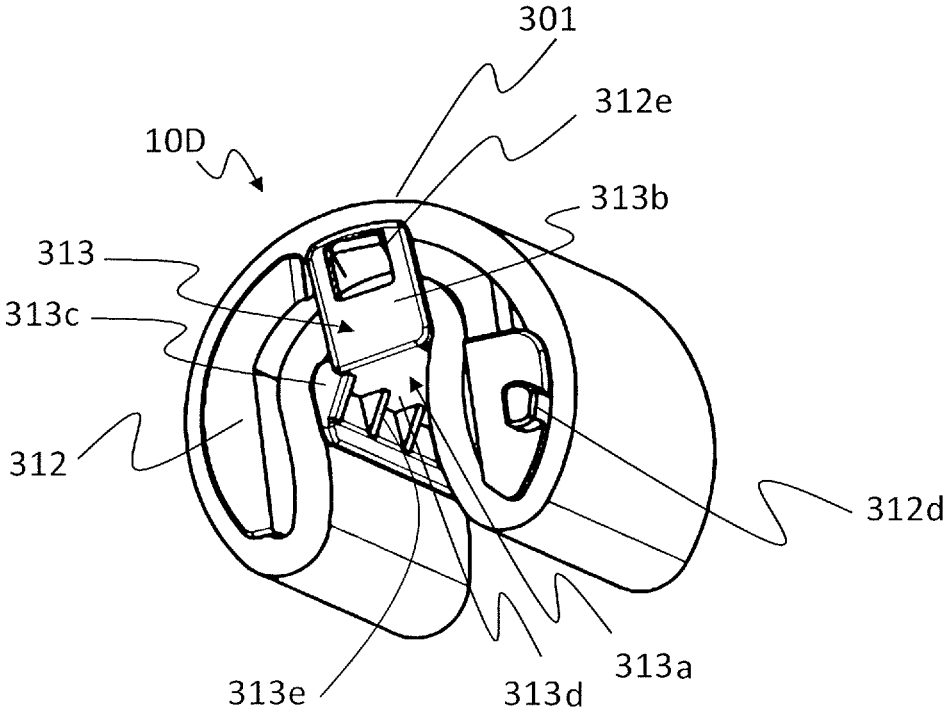
FIG. 19 is a perspective view illustrating a feed roller of a third embodiment.
Figure 20A:
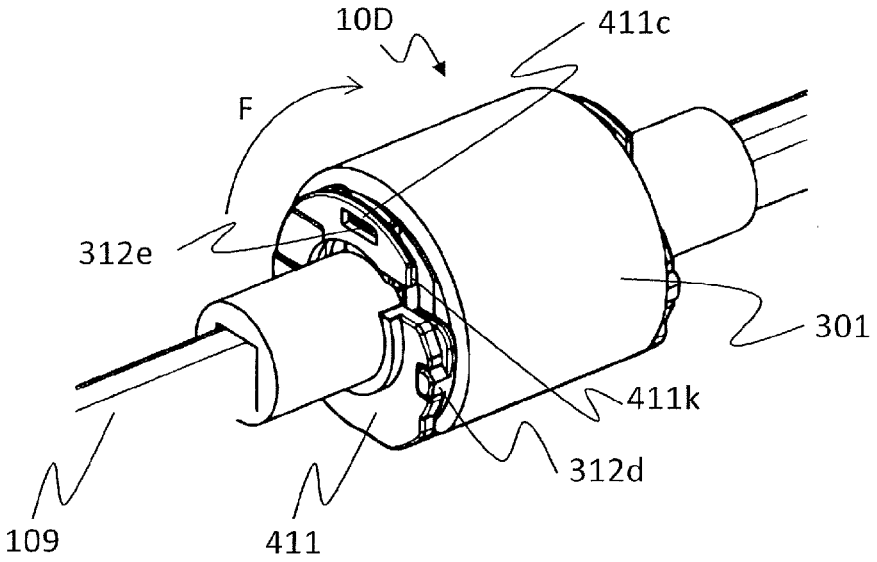
FIG. 20A is a perspective view illustrating a state in which the feed roller of the third embodiment is attached to a driving shaft.
Figure 20B:
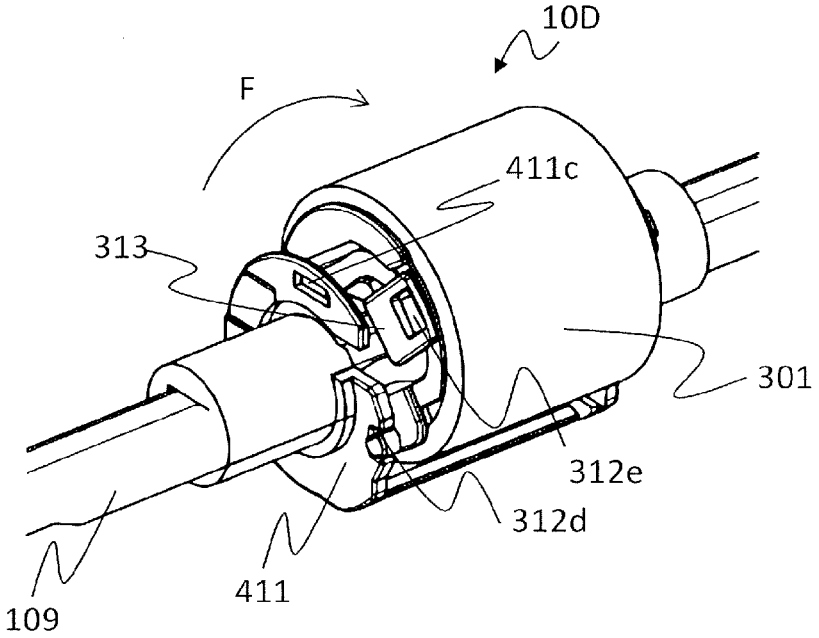
FIG. 20B is a perspective view illustrating a state in which the feed roller of the third embodiment is detached from the driving shaft.
Figure 21:
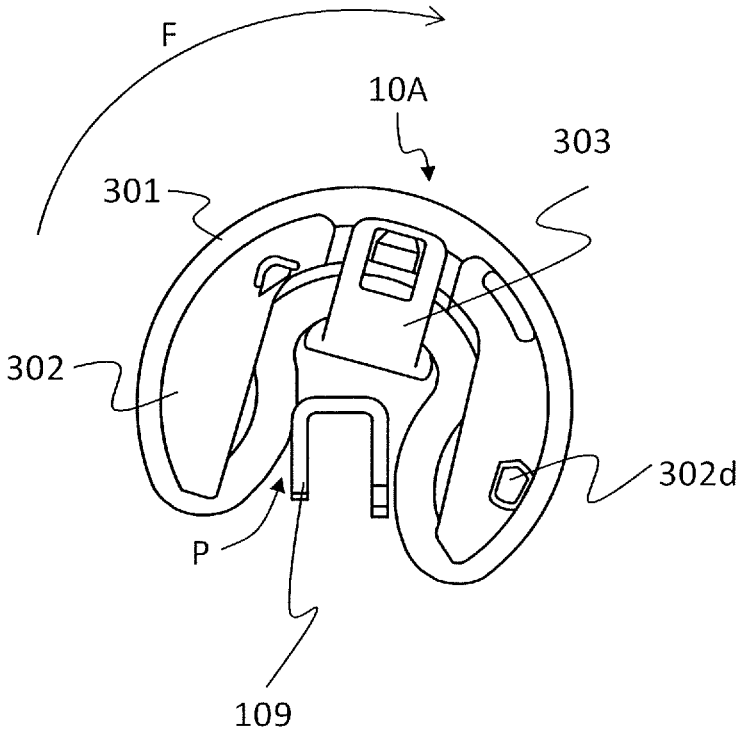
FIG. 21 is a front view illustrating a problem caused by a loosened rubber belt.
Figure 22A:
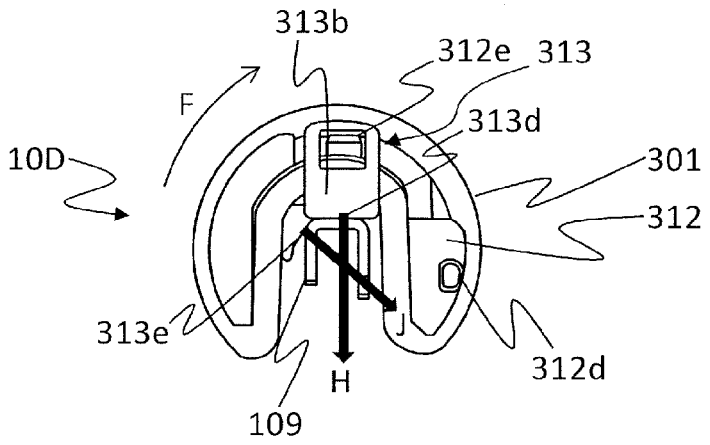
FIG. 22A illustrates a state in which the feed roller of the third embodiment is attached to the driving shaft.
Figure 22B:
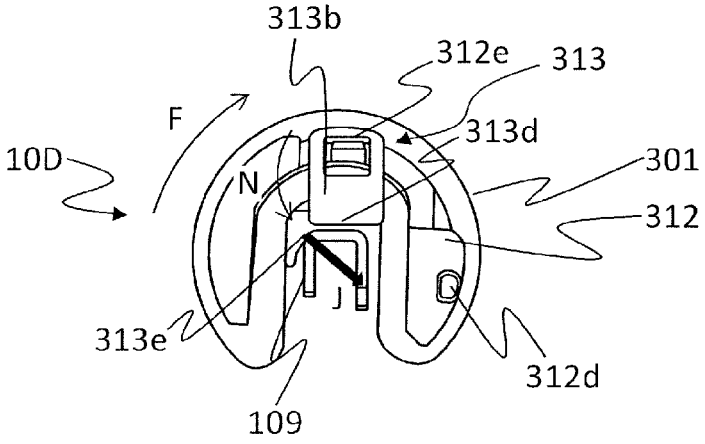
FIG. 22B illustrates an initial step in detaching the feed roller of the third embodiment from the driving shaft.
Figure 22C:
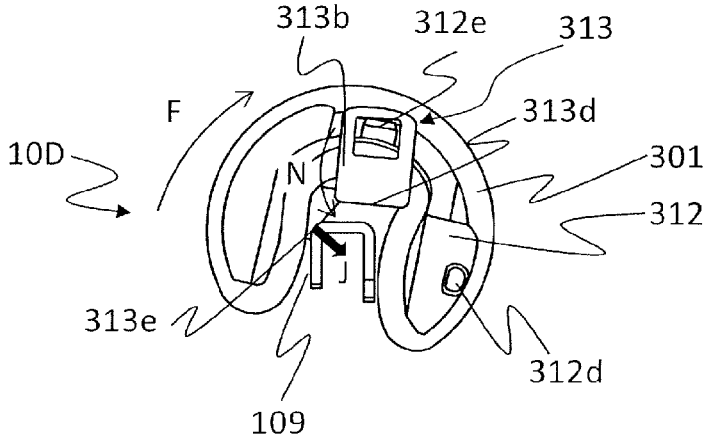
FIG. 22C illustrates a step subsequent to the step shown in FIG. 22B in detaching the feed roller of the third embodiment from the driving shaft.

Next, a third embodiment will be described with reference to FIGS. 19 through 22. It is noted that FIG. 19 is a perspective view illustrating a feed roller 10D (roller member) of the present embodiment. FIG. 20A is a perspective view illustrating a state in which the feed roller 10D is attached to the driving shaft 109 through the roller base 411, and FIG. 20B is a perspective view illustrating a state in which the feed roller 10D is detached from the driving shaft 109. FIG. 21 illustrates a state in which the rubber belt 301 is loosened in the feed roller 10A of the first embodiment. FIGS. 22A through 22C illustrate changes of states from when the feed roller 10D is attached to the roller base 411 until when the feed roller 10D is taken off from the roller base 411. It is noted that in the present embodiment, the same or corresponding components functioning in the same manner with those of the first embodiment will be denoted by the same reference numerals and an explanation thereof will be omitted here.

The feed roller 10D of the present embodiment includes a rubber belt 301 (endless belt), a roller core 312 (first holding portion), and a belt holder 313 (second holding portion). Similarly to the roller core 302 of the first embodiment, the roller core 312 includes a support portion 302*b* formed into a circular arc in section and a concave portion 302*h* (concave portion) formed into a concave shape in section, and supports a part of the rubber belt 301 as the frictional conveying portion 10*a*. The belt holder 313 includes a body portion 313*a* (contact portion), projecting portions 313*b*, and a spacer portion 313*c*. As described later, a surface of the body portion 313*a* facing the driving shaft 109 constitutes an abutting surface 313*d* (first surface) and a surface of the spacer portion 313*c* facing the driving shaft 109 constitutes an inclined surface portion 313*e* (second surface). The belt holder 313 is in contact with an outer circumferential surface of the rubber belt 301 at the body portion 313*a*. Engage opening (cavity portion) formed through the projecting portion 313*b*, i.e., a link portion, is engaged with a lock projection 312*e* (convex portion), i.e., a linked portion, provided on the roller core 312. Accordingly, the roller core 312 and the belt holder 313 constitute a holding unit holding the rubber belt 301.

The roller core 312 and the belt holder 313 will be described in detail. As shown in FIG. 20A, the roller core 312 includes an engage projection 312*d* engaging with a lock portion 411*d* provided on the roller base 411. The roller core 312 is turnably supported by the engage projection 312*d*. The engage projection 312*d* is disposed on an axial line in parallel with a center axis of the driving shaft 109, and the feed roller 10D is detached from the driving shaft 109 by turning in a direction of an arrow F centering on the engage projection 312*d*. Differing from the first embodiment, the lock projection 312*e* of the roller core 312 engages with the snap fit 411*c* (engaged portion) provided on the roller base 411. Accordingly, the lock projection 312*e* (engage portion) of the roller core 312 is the linked portion to which the belt holder 313 is linked and also constitutes a snap fit mechanism together with the snap fit 411*c*.

The roller base 411 is provided with an operating portion 411*k* enabling to unlock the snap fit 411*c*. More specifically, the snap fit 411*c* is formed on a way of an arm-like plate extending in a substantially circumferential direction of the driving shaft 109, and the operating portion 411*k* is provided as an end portion of this arm-like plate. The operating portion 411*k* is operable in a direction of opening the arm-like plate in the axial direction of the driving shaft 109 (in a direction separating away from the feed roller 10D), and the lock projection 312*e* is disengaged from the snap fit 411*c* by operating the operating portion 411*k* in the opening direction.

As shown in FIG. 19, the spacer portion 313*c* of the belt holder 313 is provided on a side far from the engage projection 312*d* of the body portion 313*a*. That is, the spacer portion 313*c* erects from the abutting surface 313*d* of the body portion 313*a* and extends in a circumferential direction of the driving shaft 109. Accordingly, the spacer portion 313*c* is positioned between the rubber belt 301 and the driving shaft 109. A surface of the spacer portion 313*c* on a side facing the driving shaft 109 is formed as the inclined surface portion 313*e* continuous to the abutting surface 313*d* by a triangular rib member erected on the abutting surface 313*d*. The inclined surface portion 313*e* is formed so as to incline along a substantially circumferential direction centering on the engage projection 312*d* as an abutting surface abutting with the driving shaft 109 at a position different from the abutting surface 313*d* in a circumferential direction (a rotation direction) of the driving shaft 109. Still further, the inclined surface portion 313*e* is configured to be contactable with the driving shaft 109 when the roller core 312 turns centering on the engage projection 312*d*.

Next, an operation for taking out the feed roller 10D of the present embodiment will be described with reference to FIGS. 22A through 22C. In a state in which the feed roller 10D is attached to the driving shaft 109, both the lock projection 312*e* and the engage projection 312*d* of the roller core 312 are locked by the roller base 411, and the feed roller 10D rotates integrally with the driving shaft 109 as shown in FIG. 22A. In this state, the body portion 313*a* of the belt holder 313 receives the resilient force of the rubber belt 301 and presses the driving shaft 109 in a direction separating from the back face portion 302*i* of the roller core 312 (in a direction of an arrow H) by the abutting surface 313*d*. Still further, the spacer portion 313*c* receives the resilient force of the rubber belt 301 and pushes the driving shaft 109 in a direction of approaching to the engage projection 312*d* (in a direction of an arrow J) by the inclined surface portion 313*e*.

When the operating portion 411*k* of the roller base 411 is operated to open and to disengage the roller core 312 from the roller base 411, the roller core 312 starts a pop-up operation of turning in a direction of an arrow F. That is, the roller core 312 receives reaction force from the driving shaft 109 through the belt holder 313 and the rubber belt 301. Because this reaction force is a force in a direction opposite to the forces indicated by the arrows J and H, respectively, the roller core 312 turns in the direction of the arrow F centering on the engage projection 312*d*.

While the belt holder 313 slides and moves in the direction of the arrow H by the resilient force of the rubber belt 301, the slide-move is restricted because the lock projection 312*e* locks the projecting portion 313*b* on a way of the pop-up operation. Due to that, the belt holder 313 starts to turn together with the roller core 312, and the abutting surface 313*d* of the belt holder 313 is separated from the driving shaft 109 as shown in FIG. 22B. At this time, the spacer portion 313*c* is located between the driving shaft 109 and the rubber belt 301 and presses the driving shaft 109 in the direction of the arrow J while being continuously in contact with the driving shaft 109 by the inclined surface portion 313*e* by receiving the resilient force of the rubber belt 301. The roller core 312 receives the reaction force from the driving shaft 109 through the belt holder 313 and the rubber belt 301. Because this reaction force is a force in the direction opposite to the arrow J, the roller core 312 rotates further in the direction of the arrow F and continues the pop-up operation. Still further, because the belt holder 313 turns in a direction of an arrow N so as to incline with respect to the roller core 312 because the rubber belt 301 is deformed in the direction of the arrow J.

As the roller core 312 turns centering on the engage projection 312*d*, the resilient force decreases due to the restoration of the rubber belt 301, thus decreasing degree of the force of the spacer portion 313*c* (indicated by length of the arrow J) pressing the driving shaft 109. Then, the feed roller 10D stops turning in the direction of the arrow F (FIG. 22C) when the resilient force of the rubber belt 301 adequately decreases so as to be balanced with its own weight, for example. In this example, the feed roller 10D stops at a position where an end of the inclined surface portion 313*e* comes into contact with the driving shaft 109. Thereby, the pop-up operation of the feed roller 10D is completed and the feed roller 10D becomes a state in which the feed roller 10D can be separated from the driving shaft 109 by manually holding the feed roller 10D. An operator holds and pulls out the roller core 312 in such a state in a direction separating the back face portion 302*i* from the driving shaft 109 (upper right in FIG. 22C for example). Then, the rubber belt 301 is taken out of the driving shaft 109 while being held by the roller core 302 and the belt holder 303.

Because the feed roller 10D of the present embodiment is constructed as described above, it is possible to improve the replaceability further by providing the spacer portion 313*c* in addition to the effects brought about by the first embodiment. This point will be described specifically below by using the feed roller 10A of the first embodiment for comparison.

As shown in FIG. 6, the belt holder 303 of the feed roller 10A is movable by the width of the gap f between the body portion 303*a* and the back face portion 302*i* of the roller core 302. Here, it is conceivable to increase a pop-up amount during replacement by increasing the gap f and the moving amount of the belt holder 303. However, if the gap f is set to be more than a difference i between heights of a top face 303*d* of the belt holder 303 and of the frictional conveying portion 10*a* of the feed roller 10A, i.e., i>f, there is a possibility that the top face 303*d* of the belt holder 303 projects out of the frictional conveying portion 10*a*. In this case, there is a possibility that the projecting top face 303*d* abuts with and damages a sheet S. Accordingly, it is hard to set the moving amount of the belt holder 303 to be more than the predetermined width (the difference i of the heights) in the feed roller 10A.

Meanwhile, the belt holder 313 of the feed roller 10D of the present embodiment includes the spacer portion 313*c* which continues to be in contact with the driving shaft 109 by the inclined surface portion 313*e* even after when the abutting surface 313*d* of the body portion 313*a* separates from the driving shaft 109 (see FIG. 22B). The spacer portion 313*c* transmits the resilient force of the rubber belt 301 to the driving shaft 109 (arrow J) and also becomes a working point receiving the reaction force of the driving shaft 109. Thereby, the feed roller 10D can receive a rotational moment in a pop-up direction (in the direction of the arrow F) as the reaction force from the driving shaft 109 even after when the belt holder 313 ends up sliding and moving in the depth direction (in the direction of the arrow H) of the concave portion 312*h*. As a result, it is possible to assure the pop-up amount of the feed roller 10D without increasing the gap f and to improve the workability during the replacement thereof.

Still further, it is conceivable such a case that the inner circumferential length of the rubber belt 301 becomes longer than a set value due to tolerance of components in the feed roller 10A of the first embodiment. In such a case, there is a possibility that a part of the largely loosened rubber belt 301 interferes with the driving shaft 109 in detaching the feed roller 10A from the roller base 401 as shown in FIG. 21. Here, because the roller core 302 of the feed roller 10A rotates in the direction of the arrow F around an axis of the engage projection 302*d* in parallel with the axial core of the driving shaft 109, a turning track of a wall face on a side opposite from the engage projection 302*d* among the concave portion 302*h* of the roller core 302 approaches the driving shaft 109. Due to that, there is a possibility that the loosened rubber belt 301 comes into contact with the driving shaft 109 at a position P on the side far from the engage projection 302*d* within a gap between the roller core 302 and the driving shaft 109. Then, because the rubber belt 301 is a material whose friction can be readily increased to increase conveyance of the sheet S, there is a case when the pop-up operation stops as the rubber belt 301 comes into contact with the driving shaft 109. Thereby, the pop-up amount decreases, hindering the operation of the operator taking out the feed roller 10A and dropping the workability during the replacement.

Meanwhile, according to the feed roller 10D of the present embodiment, the spacer portion 313*c* is located between the rubber belt 301 and the driving shaft 109 and separates them during the pop-up operation. Therefore, even in a case when the rubber belt 301 is loosened, it is possible to prevent the interference otherwise caused between the rubber belt 301 and the driving shaft 109 and to improve the workability during the replacement. Still further, according to the present embodiment, the spacer portion 313*c* is provided on the side opposite from the engage projection 312*d* which is the axis of turn in the pop-up operation. Therefore, it is possible to prevent the interference from occurring at the position (P) where the driving shaft 109 and the rubber belt 301 are liable to approach and to improve the workability during the replacement with the simple configuration.

Still further, the present embodiment is configured such that the lock projection 312*e* engaging the belt holder 313 with the roller core 312 is locked by the snap fit 411*c*. This arrangement makes it possible to simplify the feed roller 10D by using the lock projection 312*e* for the both configurations of locking the feed roller 10D to the roller base 411 and of engaging the belt holder 313 with the roller core 312. Still further, as compared to one (see FIG. 7A for example) in which the snap fit 401*c* is disposed so as to avoid the belt holder 303, like the first embodiment, the operating portion 411*k* and the snap fit 411*c* can be disposed at positions close to each other. This arrangement make it possible to restrain a displacement of the operating portion 411*k* necessary for disengaging the snap fit 411*c* from the lock projection 312*e* and to improve the operability.

It is noted that the configuration of the spacer portion 313*c* is not limited to the configuration described above, and the spacer portions may be disposed on both sides with respect to the body portion 313a for example. Still further, the inclined surface portion 313*e* is not limited to be a flat surface straightly rising from the abutting surface 313*d* and may be a curved face integrally formed with the abutting surface 313*d*. Still further, the lock projection 312*e* is not limited to be used in the configuration as the part of the snap fit mechanism, and the snap fit mechanism may constitute a hook separately from the lock projection 312*e*, like the first embodiment.

<Fourth Embodiment>

Figure 23:
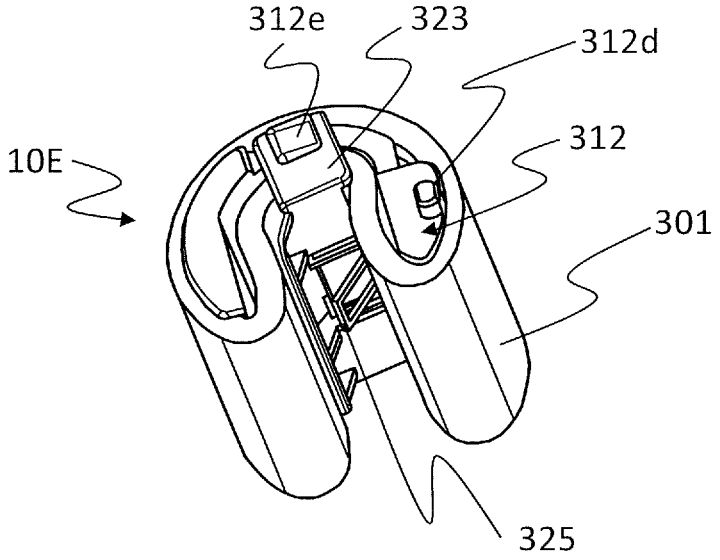
FIG. 23 is a perspective view illustrating a feed roller of a fourth embodiment.
Figure 24A:
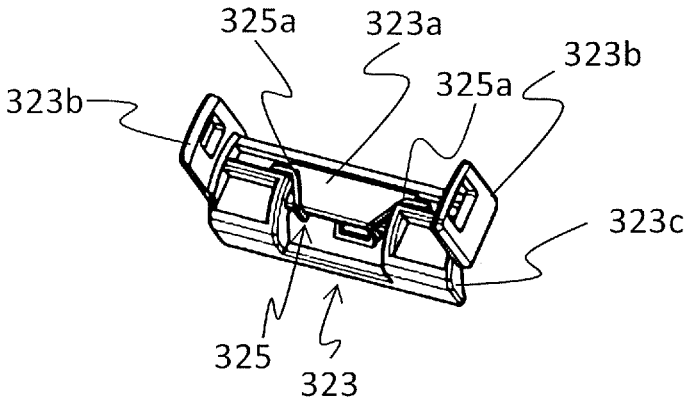
FIG. 24A is a perspective view illustrating a belt holder and a wire spring of the feed roller of the fourth embodiment.
Figure 24B:
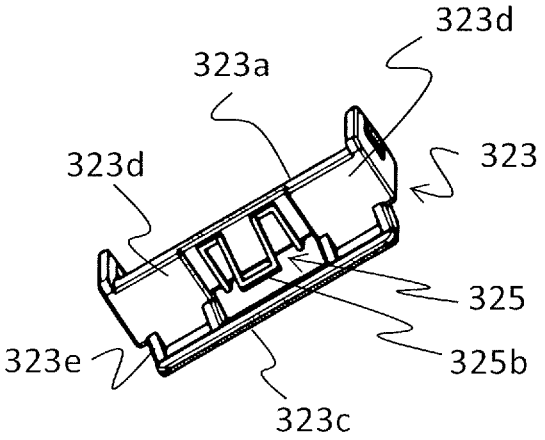
FIG. 24B is a perspective view illustrating the belt holder and the wire spring shown in FIG. 24A and viewed from another angle.
Figure 25A:
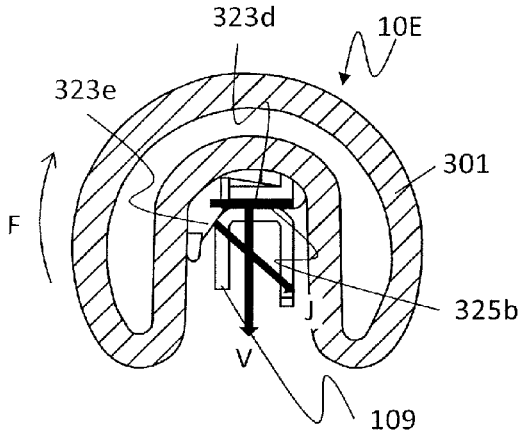
FIG. 25A is a section view illustrating a state in which the feed roller of the fourth embodiment is attached to the driving shaft.
Figure 25B:
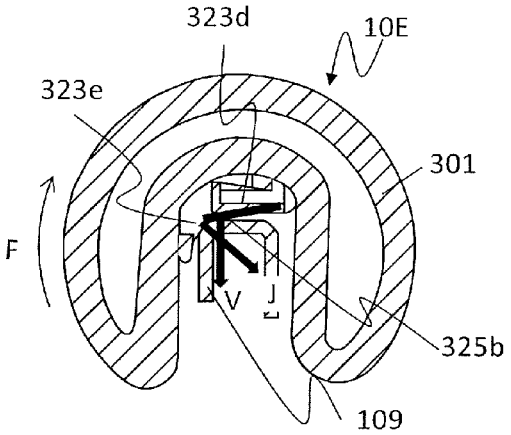
FIG. 25B is a section view illustrating a first step in detaching the feed roller of the fourth embodiment from the driving shaft.

Next, a fourth embodiment will be described with reference to FIGS. 23 through 25D. It is noted that FIG. 23 is a perspective view illustrating a feed roller 10E (roller member) of the present embodiment. FIGS. 24A and 24B are perspective views showing a belt holder 323 and a wire spring 325 of the present embodiment, where FIG. 24B is a view seen from a back direction of FIG. 24A. FIGS. 25A through 25D are section views illustrating a process in taking the feed roller 10E out of the roller base 411 and indicate that the process changes from FIG. 25A, illustrating a state in which the feed roller 10E is attached, to FIGS. 25B, 25C and 25D in order.

The feed roller 10E of the present embodiment has a configuration in which the wire spring 325, i.e., an elastic member, is added to the feed roller 10D of the third embodiment. The configuration other than that is the same with that of the third embodiment and therefore, the configuration of the present embodiment is partly in common with that of the first embodiment. Due to that, the present embodiment is configured in the same manner by the members described above, and the members functioning in the same manner will be denoted by the same reference numerals and an explanation thereof will be omitted here.

As shown in FIG. 23, the feed roller 10E of the present embodiment is constructed by a rubber belt 301 (endless belt), a roller core 312 (first holding portion), a belt holder 323 (second holding portion), and the wire spring 325. The wire spring 325 is attached to the belt holder 323 and projects on a side facing the driving shaft 109 in a state in which the feed roller 10E is detached from the driving shaft 109.

As shown in FIG. 24A, the belt holder 323 includes a body portion 323*a* (contact portion) contactable with the outer circumferential face of the rubber belt 301, projecting portions 323*b* engaged with the roller core 312, and a spacer portion 323*c* extending from the body portion 323*a*. As shown in FIGS. 24A and 24B, the wire spring 325 includes support portions 325*a* fixed to the belt holder 323 in a manner of sandwiching the body portion 323*a* and an elastic arm 325*b* projecting downward (to the side of the driving shaft 109) from the support portions 325*a*.

As shown in FIG. 25A, when the feed roller 10E is attached to the driving shaft 109, the elastic arm 325*b* of the wire spring 325 is pressed by the driving shaft 109 and is in contact closely with the body portion 323*a* of the belt holder 323. At this time, the driving shaft 109 receives a force in a direction of an arrow V by the resilient force of the rubber belt 301 through the body portion 323*a* and the wire spring 325. In the same time, the driving shaft 109 receives the resilient force of the rubber belt 301 through the spacer portion 323*c* and is pressed in a direction of an arrow J by the inclined surface portion 323*e*. It is noted that differing from the third embodiment, a lower surface 323*d* of the body portion 323*a* of the present embodiment, corresponding to the abutting surface 313*d*, is not in contact with the driving shaft 109.

When the operator detaches the feed roller 10E from the driving shaft 109, the operator unlocks the lock projection 312*e* from the snap fit 411*c* by operating the operating portion 411*k* of the roller base 411. Then, the feed roller 10E starts a pop-up operation of turning in the direction of the arrow F by reaction force caused by the driving shaft 109 to the forces indicated by the arrows J and V. While being urged toward the driving shaft 109 by the rubber belt 301, the body portion 323*a* of the belt holder 323 is urged in a direction separating away from the driving shaft 109 by a resilient force of the wire spring 325. Due to that, while the body portion 323*a* starts moving away from the driving shaft 109 soon after the start of the pop-up operation (see FIG. 25B), the body portion 323*a* transmits the resilient force of the rubber belt 301 to the driving shaft 109 through the wire spring 325 (arrow V). Then, the feed roller 10E continues to turn in the direction of the arrow F by receiving the reaction force from the driving shaft 109 by the inclined surface portion 323*e* and the elastic arm 325*b* of the wire spring 325.

Figure 25C:
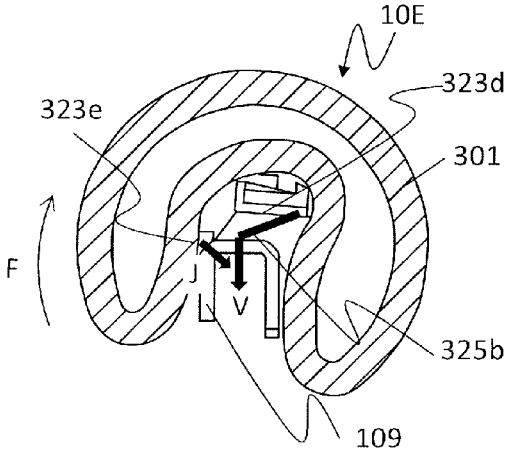
FIG. 25C is a section view illustrating a second step in detaching the feed roller of the fourth embodiment from the driving shaft.
Figure 25D:
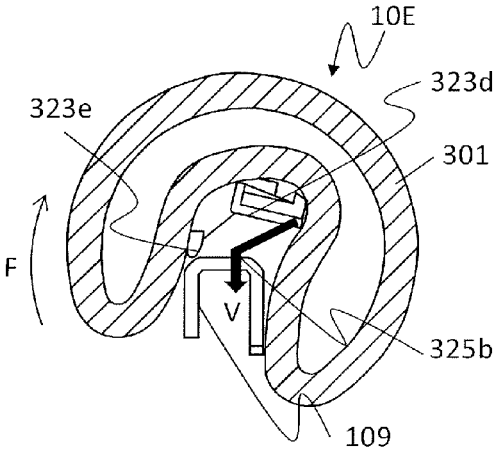
FIG. 25D is a section view illustrating a third step in detaching the feed roller of the fourth embodiment from the driving shaft.

As the pop-up operation proceeds, the wire spring 325 extends partially and an end portion of the inclined surface portion 323*e* comes into contact with the driving shaft 109 (see FIG. 25C). In this state, because the feed roller 10E receives a reaction force in a direction opposite to the force indicated by the arrow V from the driving shaft 109 by the resilient force of the wire spring 325, the feed roller 10E continues to turn in the direction of the arrow F. Then, after when the inclined surface portion 323*e* separates away from the driving shaft 109, the turn of the feed roller 10E stops and the pop-up operation ends in a state (FIG. 25D) in which the resilient force of the wire spring 325 (arrow V) is balanced with its own weight of the feed roller 10E.

Because the feed roller 10E of the present embodiment is constructed as described above, it is possible to obtain advantageous effects caused by adding the wire spring 325 (elastic member) in addition to the effects brought about by the first and third embodiments. That is, it is possible to increase the urging force and operating quantity of the pop-up operation in detaching the feed roller 10E from the driving shaft 109 by interposing the wire spring 325 between the rubber belt 301 and the driving shaft 109. Specifically, it is possible to increase momentum of the pop-up operation because the driving shaft 109 can be pressed by the force (indicated by the arrow V) in which the resilient force of the rubber belt 301 is combined with the resilient force of the wire spring 325 in the state (FIG. 25A) in which the feed roller 10E is attached to the driving shaft 109. Still further, it is possible to transmit the resilient force of the rubber belt 301 to the driving shaft 109 by the wire spring 325 when the force (indicated by the arrow J) pressing the driving shaft 109 by the inclined surface portion 323*e* decreases as the pop-up operation advances. It is then possible to increase the pop-up amount (turning amount) of the feed roller 10E as compared to the third embodiment. This arrangement makes it possible to improve the workability during the replacement by adequately adjusting the pop-up amount of the feed roller 10E.

It is noted that while the wire spring 325 is used as the elastic member in the present embodiment, any configuration may be adopted as long as it exerts an elastic force between the body portion 323*a* of the belt holder 323 and the driving shaft 109. For instance, instead of the wire spring 325, a flat spring may be used or an elastic part integrally molded with the belt holder 323 may be provided.

Still further, an action range (stroke) and resilient force of the wire spring 325 may be appropriately changed. For instance, it is possible to configure such that the feed roller 10E pops up vigorously when the snap fit 411*c* is erroneously unlocked from the lock projection 312*e* by setting the stroke of the wire spring 325 to be small and by setting the resilient force to be large. In this case, it is possible to inform the operator of the detachment of the feed roller 10E by the pop-up operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2014-151768, filed on Jul. 25, 2014, and 2015-135293, filed on Jul. 6, 2015, which are hereby incorporated by reference herein in their entirety.

What is claimed is:

1. A roller member, comprising:

an endless belt elastically deformable, the endless belt configured to convey a sheet; and a holding unit holding the endless belt, the holding unit including:

a first holding portion being in contact with an inner circumferential surface of the endless belt;

a second holding portion being in contact with an outer circumferential surface of the endless belt and movable with respect to the first holding portion; and an engage portion engaging with an engaged portion provided on a rotatable shaft, wherein the second holding portion includes a first surface abutting with the rotatable shaft in a state in which the engage portion is engaged with the engaged portion, and a second surface abutting with the rotatable shaft at a position different from the first surface in a rotation direction of the rotatable shaft in a state in which the engage portion is engaged with the engaged portion, wherein the second surface abuts with the rotatable shaft in a state in which the first surface is separated from the rotatable shaft by an operation of disengaging the engage portion from the engaged portion, and wherein the second holding portion is moved with respect to the first holding portion, in response to a disengagement of the engage portion from the engaged portion, by resilient force of the endless belt in a state in which the second holding portion is in contact with the outer surface of the endless belt.

2. The roller member according to claim 1, wherein the second holding portion is attached to the first holding portion after wrapping the endless belt around the first holding portion.

3. The roller member according to claim 1, wherein a part of the first holding portion overlaps with a part of the second holding portion as viewed from an axial line direction of the rotatable shaft.

4. The roller member according to claim 1, wherein an elastic deformation volume of the endless belt in a state in which the engage portion is engaged with the engaged portion is greater than an elastic deformation volume of the endless belt in a state in which the engage portion is disengaged from the engaged portion.

5. The roller member according to claim 1, wherein the engage portion is provided on the first holding portion.

6. The roller member according to claim 5, wherein the engage portion and the engaged portion constitute a snap fit mechanism.

7. The roller member according to claim 1, wherein the second holding portion includes a link portion, and wherein the first holding portion includes a linked portion being linked to the link portion of the second holding portion.

8. The roller member according to claim 7, wherein the link portion of the second holding portion is a cavity portion, and the linked portion of the first holding portion is a convex portion engaging with the cavity portion.

9. The roller member according to claim 1 , wherein the endless belt is detached from the shaft by an operator in a state in which the endless belt is held by the holding unit after the engage portion is disengaged from the engaged portion.

10. A sheet feeding apparatus, comprising:

a sheet stacking portion stacking a sheet; and the roller member as set forth in claim 1, wherein the endless belt of the roller member feeds the sheet stacked on the sheet stacking portion.

11. An image forming apparatus, comprising:

the sheet feeding apparatus as set forth in claim 10; and an image forming unit forming an image on a sheet fed from the sheet feeding apparatus.

12. The roller member according to claim 1, wherein the endless belt conveys a sheet by a backside surface of the inner circumferential surface held by the first holding portion.

13. The roller member according to claim 1, wherein the second holding portion includes an elastic member.

14. The roller member according to claim 13, wherein the elastic member comprises a wire spring, and the wire spring is pressed by the rotatable shaft and the second holding portion in a case in which the engage portion is engaged with the engaged portion.

15. The roller member according to claim 14, wherein the holding unit is moved away from the shaft by a resilient force of the wire spring in response to the disengagement of the engage portion from the engaged portion.

* * * * *